US010295178B2

(12) United States Patent
Chung et al.

(10) Patent No.: US 10,295,178 B2
(45) Date of Patent: May 21, 2019

(54) APPARATUSES AND METHODS FOR COMBUSTION

(71) Applicant: KING ABDULLAH UNIVERSITY OF SCIENCE AND TECHNOLOGY, Thuwal (SA)

(72) Inventors: Suk Ho Chung, Thuwal (SA); Markous Abdo, Thuwal (SA); Alaa Dawood, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 328 days.

(21) Appl. No.: 15/101,578

(22) PCT Filed: Dec. 4, 2014

(86) PCT No.: PCT/IB2014/003111

§ 371 (c)(1),
(2) Date: Jun. 3, 2016

(87) PCT Pub. No.: WO2015/083006

PCT Pub. Date: Jun. 11, 2015

(65) Prior Publication Data

US 2016/0305652 A1 Oct. 20, 2016

Related U.S. Application Data

(60) Provisional application No. 61/911,582, filed on Dec. 4, 2013.

(51) Int. Cl.
*F23D 11/38* (2006.01)
*F23D 14/02* (2006.01)
(Continued)

(52) U.S. Cl.
CPC ..... *F23D 14/02* (2013.01); *F23D 14/08* (2013.01); *F23D 14/22* (2013.01); *F23D 14/24* (2013.01);
(Continued)

(58) Field of Classification Search
CPC ..... F23D 14/22; F23D 14/24; F23D 14/58; F23D 14/70; F23D 14/02; F23D 14/08;
(Continued)

(56) References Cited

U.S. PATENT DOCUMENTS 2,836,234 A 5/1958 Sage
3,511,587 A 5/1970 Jansen et al.
(Continued)

FOREIGN PATENT DOCUMENTS

EP 1889810 2/2008
GB 1460648 1/1977
(Continued)

OTHER PUBLICATIONS

International Search Report and Written Opinion issued in PCT/IB2014/003111, dated Jun. 25, 2015.
(Continued)

*Primary Examiner* — Alfred Basichas
(74) *Attorney, Agent, or Firm* — Patent Portfolio Builders PLLC

(57) ABSTRACT

Combustion apparatuses (e.g., burners) and methods, such as those configured to encourage mixing of fluid and flame stability, among other things.

25 Claims, 14 Drawing Sheets

(51) Int. Cl.

| | |
|---|---|
| ***F23D 14/22*** | (2006.01) |
| ***F23D 14/24*** | (2006.01) |
| ***F23D 14/58*** | (2006.01) |
| ***F23D 14/70*** | (2006.01) |
| ***F23D 14/08*** | (2006.01) |
| ***F23D 14/62*** | (2006.01) |
| ***F23Q 3/00*** | (2006.01) |

(52) U.S. Cl.
CPC ..... *F23D 14/58* (2013.01); *F23D 14/62* (2013.01); *F23D 14/70* (2013.01); *F23Q 3/00* (2013.01)

(58) Field of Classification Search
CPC ..... F23D 14/62; F23D 11/38; F23D 11/383; F23D 2900/21007; F23Q 3/00; F23N 2027/02
See application file for complete search history.

(56) References Cited

U.S. PATENT DOCUMENTS

| | | | | |
|---|---|---|---|---|
| 3,782,884 | A | 1/1974 | Shumaker | |
| 4,443,228 | A * | 4/1984 | Schlinger | C01B 3/363 239/112 |
| 5,743,723 | A | 4/1998 | Iatrides et al. | |
| 8,292,615 | B2 | 10/2012 | Spangelo et al. | |
| 2002/0086257 | A1 | 7/2002 | Primdahl | |
| 2006/0042253 | A1 | 3/2006 | Fortuna et al. | |
| 2009/0272822 | A1 | 11/2009 | Davis et al. | |
| 2013/0084224 | A1 | 4/2013 | Ergut | |
| 2014/0038114 | A1 * | 2/2014 | Kelly | F23Q 3/00 431/6 |

FOREIGN PATENT DOCUMENTS

| | | | |
|---|---|---|---|
| JP | H0328606 | B2 | 4/1991 |
| JP | H06281115 | A | 10/1994 |
| JP | H07180816 | A | 7/1995 |
| JP | 2004108734 | A | 4/2004 |
| KR | 100225750 | | 10/1999 |
| WO | 1993017279 | A1 | 9/1993 |

OTHER PUBLICATIONS

International Search Report and Written Opinion issued in related application No. PCT/IB2014/066607, dated Mar. 27, 2015.
EP Communication pursuant to Rules 70(2) and 70a(2) EPC in related European Application No. 14867643, dated Aug. 21, 2017.
EP Communication with Extended European Search Report in related European Application No. 14867643, dated Aug. 2, 2017 (KR reference cited in IDS Sep. 7, 2016).
JP Notice of Reasons for Rejection in related JP 2016-536592, dispatched Oct. 3, 2018 (References D1 and D4 previously cited in IDS of Sep. 7, 2016).

* cited by examiner

APPARATUSES AND METHODS FOR COMBUSTION

CROSS-REFERENCE TO RELATED APPLICATIONS

This is a national phase application under 35 U.S.C. § 371 of International Application No. PCT/IB2014/003111 filed Dec. 4, 2014, which claims the benefit of U.S. Provisional Patent Application No. 61/911,582, filed Dec. 4, 2013, the contents of which applications are incorporated by reference in their entirety.

BACKGROUND

1. Field of the Invention

The present invention relates generally to combustion apparatuses (e.g., burners) and methods, and more particularly, but not by way of limitation, to combustion apparatuses and methods configured to encourage mixing of fluid and flame stability, among other things.

2. Description of Related Art

Examples of combustion apparatuses and methods are disclosed, for example, in Korean Reg. No. 1002257500000 and U.S. Pat. No. 2,836,234.

SUMMARY

This disclosure includes embodiments of combustion apparatuses (e.g., burners) and methods configured, for example, to encourage mixing of fluid and flame stability, among other things. The disclosed combustion apparatuses and methods can—in part by utilizing the Coanda effect—increase flame stability, increase burner loads and burn efficiencies, increase turbulent fluid flow after fluid exits the apparatuses and strengthen the degree of strain rate (e.g., by maximizing the velocity gradient and jet impingement of fluid moving through the apparatuses), increase blow-off velocity, increase mixing of fluid that exits the apparatuses, and decrease flashback (e.g., by reducing quenching distance of reactants while in contact with the apparatuses). Further, the present apparatuses and methods permit variation of parameters, such as temperature, flame height, fluid flow rate, and types and compositions of fluid moving through the apparatuses, among other things.

Some embodiments of the present combustion apparatuses comprise a center member having a longitudinal axis and comprising: a body, where at least a portion of the body is substantially cylindrical; and a tip integral with the body, where at least a portion of the tip is substantially hemispherical; a first outer member comprising: a body; a tip integral with the body; and a bore concentric with the longitudinal axis of the center member; where the first outer member is positioned such that a first channel is defined between the first outer member and the center member; and a second outer member comprising: a body; a tip integral with the body; and a bore concentric with the longitudinal axis of the center member; where the second outer member is positioned such that a second channel is defined between the second outer member and the first outer member; where the apparatus is configured to: permit fluid to move through the first channel and out of the tip of the first outer member; and permit fluid to move through the second channel and out of the tip of the second outer member. In some embodiments, at least a portion of the tip of the first outer member and at least a portion of the tip of the second outer member each extends toward the tip of the center member. In some embodiments, the center member is 250 to 320 millimeters in length. In some embodiments, the center member is 285 millimeters in length. In some embodiments, the center member comprises a diameter of 25 to 75 millimeters. In some embodiments, the center member comprises a diameter of 50 millimeters. In some embodiments, the first outer member is 230 to 300 millimeters in length. In some embodiments, the first outer member is 265 millimeters in length. In some embodiments, the bore of the first outer member comprises a diameter of 20 to 80 millimeters. In some embodiments, the bore of the first outer member comprises a diameter of 56 millimeters. In some embodiments, the first outer member comprises a diameter of 70 to 120 millimeters. In some embodiments, the first outer member comprises a diameter of 96 millimeters. In some embodiments, the second outer member is 190 to 260 millimeters in length. In some embodiments, the second outer member is 228 millimeters in length. In some embodiments, the bore of the second outer member comprises a diameter of 70 to 140 millimeters. In some embodiments, the bore of the second outer member comprises a diameter of 106 millimeters. In some embodiments, the second outer member comprises a diameter of 110 to 160 millimeters. In some embodiments, the second outer member comprises a diameter of 131.5 millimeters. In some embodiments, at least a portion of the first channel comprises a width of 3 millimeters. In some embodiments, at least a portion of the second channel comprises a width of 5 millimeters. In some embodiments, the center member is adjustable with respect to the first outer member and the second outer member such that at least a portion of the first channel and the second channel can change in width. In some embodiments, the first outer member is adjustable with respect to the center member such that at least a portion of the first channel can change in width. In some embodiments, the second outer member is adjustable with respect to the center member such that at least a portion of the second channel can change in width. In some embodiments, the apparatus further comprises four inlets in fluid communication with the first channel through which fluid can enter the first channel; and four inlets in fluid communication with the second channel through which fluid can enter the second channel. In some embodiments, the tip of the center member has a first end and a second end, and the second end of the tip is substantially concave. In some embodiments, the apparatus further comprises a swirling vane coupled to the center member and extending at least partially into the first channel such that fluid moving through the first channel is disturbed. In some embodiments, the apparatus further comprises a swirling vane coupled to the center member and extending at least partially into the second channel such that fluid moving through the first channel and the second channel is disturbed. In some embodiments, the apparatus further comprises a swirling vane coupled to the center member, where if the center member comprises a bore concentric with the longitudinal axis of the center member and extending through the body and the tip of the center member, fluid moving through the bore of the center member is disturbed. In some embodiments, the first outer member is configured such that fluid can be introduced into the first channel substantially perpendicular to the first channel. In some embodiments, the second outer member is configured such that fluid can be introduced into the second channel substantially perpendicular to the second channel. In some embodiments, the apparatus further comprises a spark plug coupled to the center member.

Some embodiments of the present combustion apparatuses comprise a center member having a longitudinal axis and comprising: a body, where at least a portion of the body is substantially cylindrical; a tip integral with the body, where at least a portion of the tip is substantially hemispherical; and a bore concentric with the longitudinal axis of the center member, the bore extending through the body and the tip; and a first outer member comprising: a body; a tip integral with the body; and a bore concentric with the longitudinal axis of the center member; where the first outer member is positioned such that a first channel is defined between the first outer member and the center member, a second outer member comprising: a body; a tip integral with the body; and a bore concentric with the longitudinal axis of the center member; where the second outer member is positioned such that a second channel is defined between the second outer member and the first outer member; where the apparatus is configured to: permit fluid to move through the bore of the center member and out of the tip of the center member; permit fluid to move through the first channel and out of the tip of the first outer member; and permit fluid to move through the second channel and out of the tip of the second outer member. In some embodiments, at least a portion of the tip of the first outer member and at least a portion of the tip of the second outer member each extends toward the tip of the center member. In some embodiments, the center member is 250 to 320 millimeters in length. In some embodiments, the center member is 285 millimeters in length. In some embodiments, the center member comprises a diameter of 25 to 75 millimeters. In some embodiments, the center member comprises a diameter of 50 millimeters. In some embodiments, the first outer member is 230 to 300 millimeters in length. In some embodiments, the first outer member is 265 millimeters in length. In some embodiments, the bore of the first outer member comprises a diameter of 20 to 80 millimeters. In some embodiments, the bore of the first outer member comprises a diameter of 56 millimeters. In some embodiments, the first outer member comprises a diameter of 70 to 120 millimeters. In some embodiments, the first outer member comprises a diameter of 96 millimeters. In some embodiments, the second outer member is 190 to 260 millimeters in length. In some embodiments, the second outer member is 228 millimeters in length. In some embodiments, the bore of the second outer member comprises a diameter of 70 to 140 millimeters. In some embodiments, the bore of the second outer member comprises a diameter of 106 millimeters. In some embodiments, the second outer member comprises a diameter of 110 to 160 millimeters. In some embodiments, the second outer member comprises a diameter of 131.5 millimeters. In some embodiments, at least a portion of the first channel comprises a width of 3 millimeters. In some embodiments, at least a portion of the second channel comprises a width of 5 millimeters. In some embodiments, the center member is adjustable with respect to the first outer member and the second outer member such that at least a portion of the first channel and the second channel can change in width. In some embodiments, the first outer member is adjustable with respect to the center member such that at least a portion of the first channel can change in width. In some embodiments, the second outer member is adjustable with respect to the center member such that at least a portion of the second channel can change in width. In some embodiments, the apparatus further comprises four inlets in fluid communication with the first channel through which fluid can enter the first channel; and four inlets in fluid communication with the second channel through which fluid can enter the second channel. In some embodiments, the tip of the center member has a first end and a second end, and the second end of the tip is substantially concave. In some embodiments, the apparatus further comprises a swirling vane coupled to the center member and extending at least partially into the first channel such that fluid moving through the first channel is disturbed. In some embodiments, the apparatus further comprises a swirling vane coupled to the center member and extending at least partially into the second channel such that fluid moving through the first channel and the second channel is disturbed. In some embodiments, the apparatus further comprises a swirling vane coupled to the center member such that fluid moving through the bore of the center member is disturbed. In some embodiments, the first outer member is configured such that fluid can be introduced into the first channel substantially perpendicular to the first channel. In some embodiments, the second outer member is configured such that fluid can be introduced into the second channel substantially perpendicular to the second channel. In some embodiments, the apparatus further comprises a spark plug coupled to the center member.

Some embodiments of the present combustion apparatuses comprise a base; and a center member having a longitudinal axis and comprising: a body coupled to the base, where at least a portion of the body is substantially cylindrical; and a tip integral with the body, where at least a portion of the tip is substantially hemispherical; a first outer member comprising: a body; a tip integral with the body, where at least a portion of the tip of the center member is farther from the base than the tip of the first outer member; and a bore concentric with the longitudinal axis of the center member; where the first outer member is positioned such that a first channel is defined between the first outer member and the center member; and a second outer member comprising: a body; a tip integral with the body, where at least a portion of the tip of the center member is farther from the base than the tip of the second outer member; and a bore concentric with the longitudinal axis of the center member; where the second outer member is positioned such that a second channel is defined between the second outer member and the first outer member; where the apparatus is configured to: permit fluid to move through the first channel and out of the tip of the first outer member; and permit fluid to move through the second channel and out of the tip of the second outer member. In some embodiments, at least a portion of the tip of the first outer member and at least a portion of the tip of the second outer member each extends toward the tip of the center member. In some embodiments, the center member is 250 to 320 millimeters in length. In some embodiments, the center member is 285 millimeters in length. In some embodiments, the center member comprises a diameter of 25 to 75 millimeters. In some embodiments, the center member comprises a diameter of 50 millimeters. In some embodiments, the first outer member is 230 to 300 millimeters in length. In some embodiments, the first outer member is 265 millimeters in length. In some embodiments, the bore of the first outer member comprises a diameter of 20 to 80 millimeters. In some embodiments, the bore of the first outer member comprises a diameter of 56 millimeters. In some embodiments, the first outer member comprises a diameter of 70 to 120 millimeters. In some embodiments, the first outer member comprises a diameter of 96 millimeters. In some embodiments, the second outer member is 190 to 260 millimeters in length. In some embodiments, the second outer member is 228 millimeters in length. In some embodiments, the bore of the second outer member comprises a diameter of 70 to 140 millimeters. In some embodiments, the bore of the second outer member comprises a diameter of 106 millimeters. In some embodiments, the second outer member comprises a diameter of 110 to 160 millimeters. In some embodiments, the second outer member comprises a diameter of 131.5 millimeters. In some embodiments, at least a portion of the first channel comprises a width of 3 millimeters. In some embodiments, at least a portion of the second channel comprises a width of 5 millimeters. In some embodiments, the center member is adjustable with respect to the first outer member and the second outer member such that at least a portion of the first channel and the second channel can change in width. In some embodiments, the first outer member is adjustable with respect to the center member such that at least a portion of the first channel can change in width. In some embodiments, the second outer member is adjustable with respect to the center member such that at least a portion of the second channel can change in width. In some embodiments, the apparatus further comprises four inlets in fluid communication with the first channel through which fluid can enter the first channel; and four inlets in fluid communication with the second channel through which fluid can enter the second channel. In some embodiments, the tip of the center member has a first end and a second end, and the second end of the tip is substantially concave. In some embodiments, the apparatus further comprises a swirling vane coupled to the center member and extending at least partially into the first channel such that fluid moving through the first channel is disturbed. In some embodiments, the apparatus further comprises a swirling vane coupled to the center member and extending at least partially into the second channel such that fluid moving through the first channel and the second channel is disturbed. In some embodiments, the apparatus further comprises a swirling vane coupled to the center member, where if the center member comprises a bore concentric with the longitudinal axis of the center member and extending through the body and the tip of the center member, fluid moving through the bore of the center member is disturbed. In some embodiments, the first outer member is configured such that fluid can be introduced into the first channel substantially perpendicular to the first channel. In some embodiments, the second outer member is configured such that fluid can be introduced into the second channel substantially perpendicular to the second channel. In some embodiments, the apparatus further comprises a spark plug coupled to the center member.

Some embodiments of the present methods comprise introducing a first fluid into a first channel defined by: a center member having a tip, where at least a portion of the tip is substantially hemispherical; and a first outer member; introducing a second fluid into a second channel defined by the first outer member and a second outer member; permitting the first fluid and the second fluid to flow over the tip of the center member and to mix; and igniting the mixture of the first fluid and the second fluid. In some embodiments, the method further comprises introducing the first fluid into the first channel substantially perpendicular to the first channel. In some embodiments, the method further comprises introducing the second fluid into the second channel substantially perpendicular to the second channel. In some embodiments, the method further comprises adjusting the center member with respect to the first outer member and the second outer member such that at least a portion of the first channel and the second channel changes in width. In some embodiments, the method further comprises adjusting the first outer member with respect to the center member such that at least a portion of the first channel changes in width. In some embodiments, a width of the at least a portion of the first channel is similar to a quenching distance. In some embodiments, the method further comprises adjusting the second outer member with respect to the center member such that at least a portion of the second channel changes in width. In some embodiments, a width of the at least a portion of the second channel is similar to a quenching distance. In some embodiments, a spark plug is coupled to the center member, and the method further comprises igniting the mixture of the first fluid and the second fluid with the spark plug. In some embodiments, the first fluid comprises fuel and the second fluid comprises air. In some embodiments, the first fluid comprises air and the second fluid comprises fuel. In some embodiments, the first fluid comprises fuel and the second fluid comprises an oxidizer. In some embodiments, the first fluid comprises an oxidizer and the second fluid comprises fuel. In some embodiments, the first fluid comprises a mixture of air and fuel and the second fluid comprises a mixture of fuel and air. In some embodiments, the first fluid comprises a mixture of oxidizer and fuel and the second fluid comprises a mixture of fuel and oxidizer. In some embodiments, the first fluid comprises a lean pre-mixture and the second fluid comprises a rich pre-mixture. In some embodiments, the lean pre-mixture and the rich pre-mixture are inflammable. In some embodiments, the first fluid comprises a rich pre-mixture and the second fluid comprises a lean pre-mixture. In some embodiments, the lean pre-mixture and the rich pre-mixture are inflammable.

Some embodiments of the present methods comprise introducing a first fluid into a first channel defined by a center member and a first outer member; introducing a second fluid into a second channel defined by the first outer member and a second outer member; introducing a third fluid through a bore of the center member, where the center member has a longitudinal axis and comprises: a body, where at least a portion of the body is substantially cylindrical; and a tip integral with the body, where at least a portion of the tip is substantially hemispherical; where the bore of the center member is concentric with the longitudinal axis of the center member and extends through the body and the tip; permitting the first fluid and the second fluid to flow over the tip of the center member and to mix with the third fluid; and igniting the mixture of the first fluid, the second fluid, and the third fluid. In some embodiments, the method further comprises introducing the first fluid into the first channel substantially perpendicular to the first channel. In some embodiments, the method further comprises introducing the second fluid into the second channel substantially perpendicular to the second channel. In some embodiments, the method further comprises adjusting the center member with respect to the first outer member and the second outer member such that at least a portion of the first channel and the second channel changes in width. In some embodiments, the method further comprises adjusting the first outer member with respect to the center member such that at least a portion of the first channel changes in width. In some embodiments, a width of the at least a portion of the second channel is similar to a quenching distance. In some embodiments, the method further comprises adjusting the second outer member with respect to the center member such that at least a portion of the second channel changes in width. In some embodiments, a width of the at least a portion of the first channel is similar to a quenching distance. In some embodiments, a spark plug is coupled to the center member, and the method further comprises igniting the mixture of the first fluid, the second fluid, and the third fluid with the spark plug. In some embodiments, the first fluid comprises fuel and the second fluid comprises air. In some embodiments, the first fluid comprises air and the second fluid comprises fuel. In some embodiments, the first fluid comprises fuel and the second fluid comprises an oxidizer. In some embodiments, the first fluid comprises an oxidizer and the second fluid comprises fuel. In some embodiments, the first fluid comprises a mixture of air and fuel and the second fluid comprises a mixture of fuel and air. In some embodiments, the first fluid comprises a mixture of oxidizer and fuel and the second fluid comprises a mixture of fuel and oxidizer. In some embodiments, the first fluid comprises a lean pre-mixture and the second fluid comprises a rich pre-mixture. In some embodiments, the lean pre-mixture and the rich pre-mixture are inflammable. In some embodiments, the first fluid comprises a rich pre-mixture and the second fluid comprises a lean pre-mixture. In some embodiments, the lean pre-mixture and the rich pre-mixture are inflammable. In some embodiments, the first fluid comprises fuel, the second fluid comprises air, and the third fluid comprises fuel. In some embodiments, the first fluid comprises air, the second fluid comprises fuel, and the third fluid comprises fuel.

The term "coupled" is defined as connected, although not necessarily directly, and not necessarily mechanically. Two items are "couplable" if they can be coupled to each other. Unless the context explicitly requires otherwise, items that are couplable are also decouplable, and vice-versa. One non-limiting way in which a first structure is couplable to a second structure is for the first structure to be configured to be coupled (or configured to be couplable) to the second structure. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus, or a component of an apparatus that "comprises," "has," "includes" or "contains" one or more elements or features possesses those one or more elements or features, but is not limited to possessing only those elements or features. Likewise, a method that "comprises," "has," "includes" or "contains" one or more steps possesses those one or more steps, but is not limited to possessing only those one or more steps. Additionally, terms such as "first" and "second" are used only to differentiate structures or features, and not to limit the different structures or features to a particular order.

Any embodiment of any of the present combustion apparatuses and methods can consist of or consist essentially of—rather than comprise/include/contain/have—any of the described elements and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. At least some of the figures depict graphical symbols or representations that will be understood by those of ordinary skill in the art. The embodiments of the present combustion apparatuses and their components shown in the figures are drawn to scale.

DESCRIPTION OF ILLUSTRATIVE EMBODIMENTS

Figure 1:
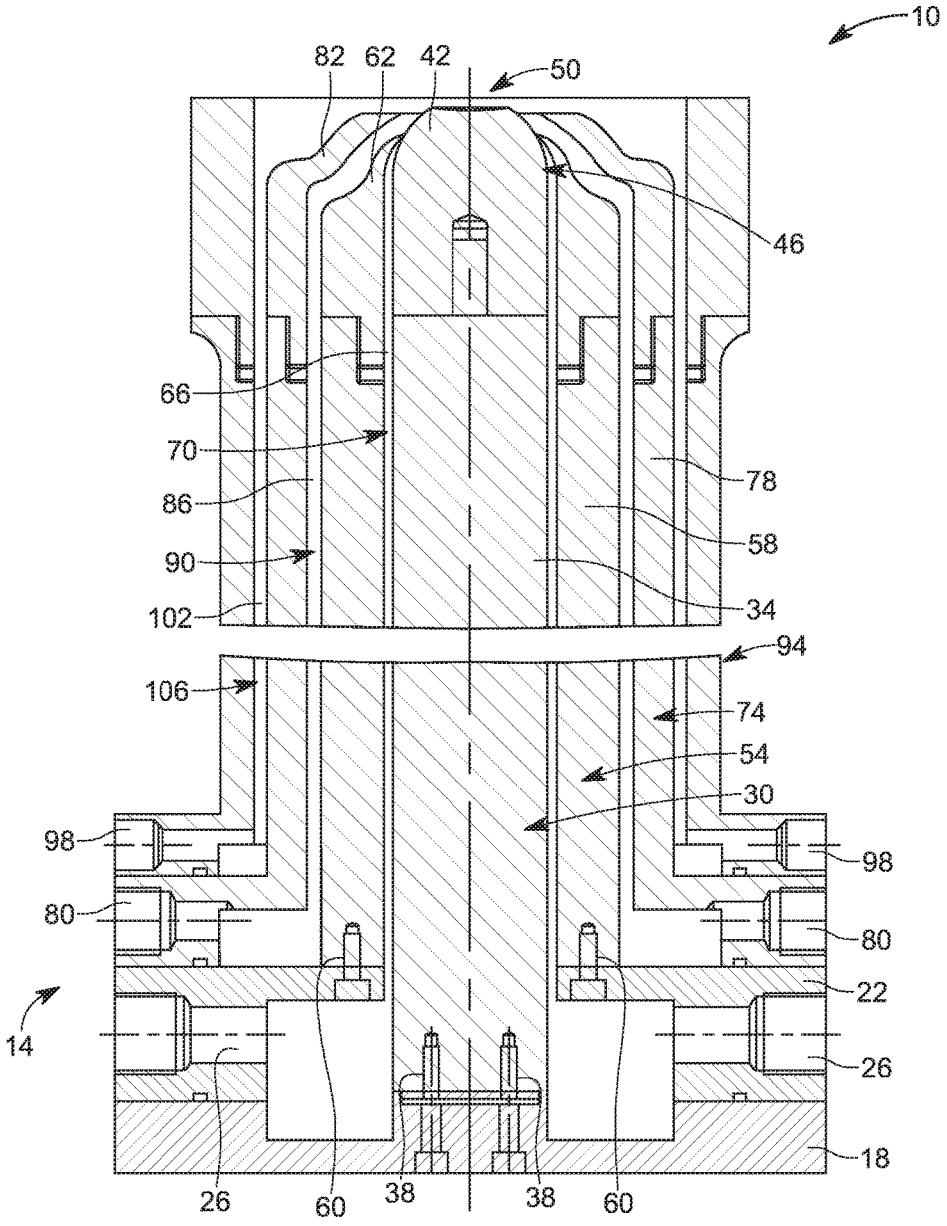
FIG. 1 depicts a side, cross-sectional view of an embodiment of a combustion apparatus comprising a base, a center member, a first outer member positioned such that a first channel is defined between the first outer member and the center member, and a second outer member positioned such that a second channel is defined between the second outer member and the first outer member.
Figure 2:
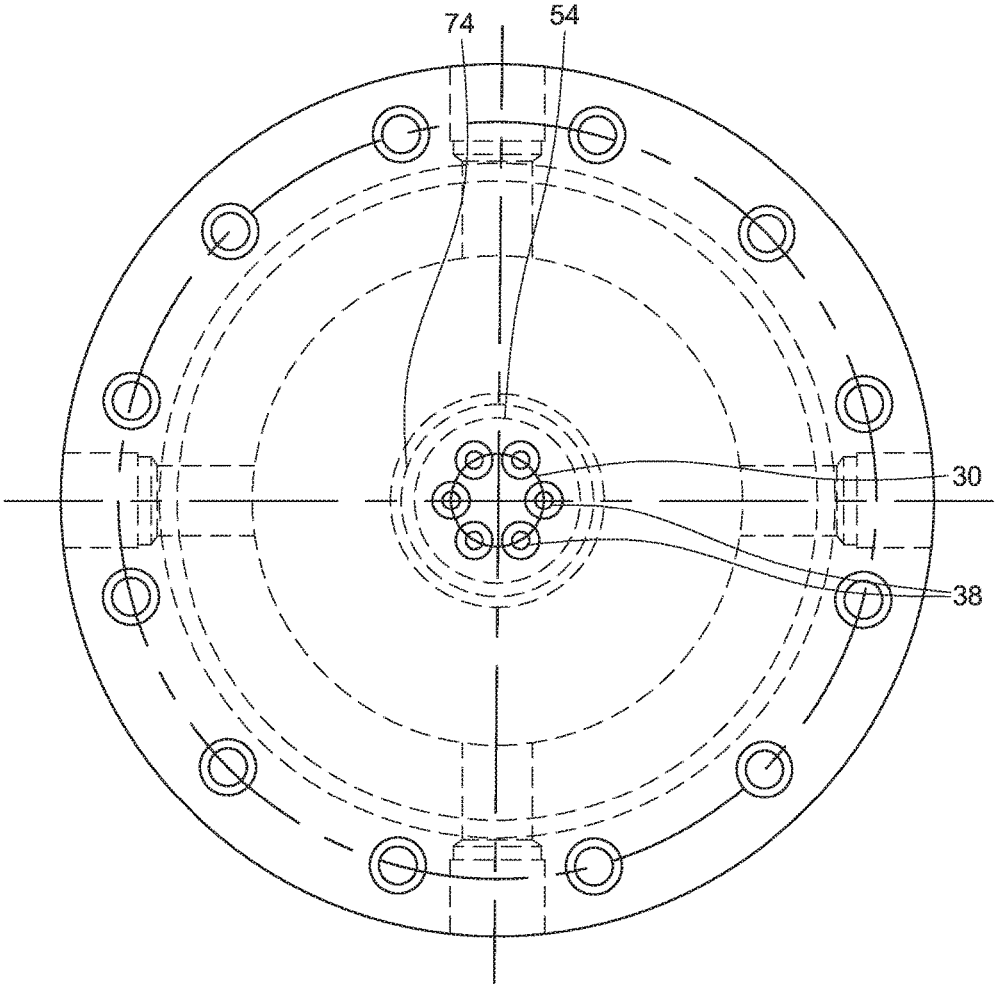
FIG. 2 depicts a top view of the combustion apparatus of FIG. 1.

Referring now to the drawings, and more particularly to FIGS. 1-2, there is shown combustion apparatus 10 comprising base 14. Base 14 can comprise any number of members configured to, for example, stabilize combustion apparatus 10, provide fluid to combustion apparatus 10, and the like. For example, in the embodiment shown in FIG. 1, base 14 comprises lower latitudinal member 18 coupled to upper longitudinal members 22. Lower latitudinal member 18 can be coupled to upper latitudinal member 22 in any suitable way (e.g., bolts, nails, adhesives, welds, and the like). In other embodiments, lower latitudinal member 18 and upper latitudinal member 22 can be integral (e.g., formed of the same piece of material). In the embodiment shown in FIG. 1, apparatus 10 comprises inlets 26 extending through base 14 (e.g., lower latitudinal member 18 coupled to upper longitudinal members 22). Apparatus 10 can comprise any number of inlets 26, such as, for example, one, two, three, four, five, six, or more inlets 26. Inlets 26 are in fluid communication with apparatus 10 such that fluid can enter apparatus 10 through inlets 26.

In the embodiment shown, combustion apparatus 10 further comprises center member 30 having a longitudinal axis. Center member 30 includes body 34 coupled to base 14 (e.g., lower latitudinal member 18). In the embodiment shown, body 34 of center member 30 is coupled to base 14 (e.g., lower latitudinal member 18) by screws 38 (e.g., six screws 38, as depicted in FIG. 2). However, in some embodiments, body 34 of center member 30 can be coupled to base 14 (e.g., lower latitudinal member 18) in any suitable way (e.g., bolts, nails, adhesives, welds, and the like); and in other embodiments, base 14 (e.g., lower latitudinal member 18) and center member 30 can be integral (e.g., formed of the same piece of material). In the embodiment shown, body 34 of center member 30 is substantially cylindrical. Center member 30 also includes tip 42, which is integral with body 34. In the embodiment shown, tip 42 of center member 30 is substantially hemispherical. Tip 42 comprises first end 46, which is proximal to base 14 and integral with body 34, and second end 50, which is distal to base 14. In some embodiments, center member 30 comprises a length of 250 to 320 millimeters (e.g., 285 millimeters); and in other embodiments, a length of center member 30 can be less than 250 millimeters (e.g., 245, 240, 235 millimeters, or less) or more than 320 millimeters (e.g., 325, 330, 335 millimeters, or more). In some embodiments, body 34 of center member 30 comprises a diameter of 25 to 75 millimeters (e.g., 50 millimeters); and in other embodiments, a diameter of body 34 of center member 30 can be less than 25 millimeters (e.g., 20, 15, 10 millimeters, or less) or more than 75 millimeters (e.g., 80, 85, 90 millimeters, or more). In some embodiments, a maximum diameter of tip 42 of center member 30 comprises a diameter of 25 to 70 millimeters (e.g., 50 millimeters); and in other embodiments, a maximum diameter of tip 42 of center member 30 can be less than 25 millimeters (e.g., 20, 15, 10 millimeters, or less) or more than 70 millimeters (e.g., 75, 80, 85 millimeters, or more).

In the embodiment shown, combustion apparatus 10 further comprises first outer member 54. First outer member 54 includes body 58 coupled to base 14 (e.g., upper latitudinal member 22). In the embodiment shown, body 58 of first outer member 54 is coupled to base 14 (e.g., upper latitudinal member 22) by screws 60. However, in some embodiments, body 58 of first outer member 54 can be coupled to base 14 (e.g., upper latitudinal member 22) in any suitable way (e.g., bolts, nails, adhesives, welds, and the like); and in other embodiments, base 14 (e.g., upper latitudinal member 22) and first outer member 54 can be integral (e.g., formed of the same piece of material). In the embodiment shown, body 58 of first outer member 54 is substantially cylindrical. First outer member 54 also includes tip 62, which is integral with body 54. In the embodiment shown, tip 62 of first outer member 54 is substantially curved. In the embodiment shown, at least a portion of tip 42 of center member 30 is farther from base 14 than tip 62 of first outer member 54. Further, in the embodiment shown, at least a portion of tip 62 of first outer member 54 extends toward tip 42 of center member 30. In some embodiments, first outer member 54 comprises a length of 230 to 300 millimeters (e.g., 265 millimeters); and in other embodiments, a length of first outer member 54 can be less than 230 millimeters (e.g., 235, 225, 220 millimeters, or less) or more than 300 millimeters (e.g., 305, 310, 315 millimeters, or more). In some embodiments, first outer member 54 comprises a diameter of 70 to 120 millimeters (e.g., 96 millimeters); and in other embodiments, a diameter of first outer member 54 can be less than 70 millimeters (e.g., 65, 60, 55 millimeters, or less) or more than 120 millimeters (e.g., 125, 130, 135 millimeters, or more). In the embodiment shown, first outer member 54 further comprises bore 66, which is concentric with the longitudinal axis of center member 30. Bore 66 extends through body 58 and tip 62. Furthermore, first outer member 54 is positioned such that channel 70 (a portion of bore 66) is defined between first outer member 54 and center member 30. For example, in some embodiments, channel 70 can comprise a width of 1 and 5 millimeters (e.g., 3 millimeters). Such widths of channel 70 can be used, for example, with gaseous fuels and air. As another example, a width of channel 70 near tip 42 of center member 30 and tip 62 of first outer member 54 can be equal to or less than a quenching distance. In other embodiments, a width of channel 70 near tip 42 of center member 30 and tip 62 of first outer member 54 can be equal to or greater than a quenching distance. In some embodiments, bore 66 of first outer member 54 comprises a diameter of 20 to 80 millimeters (e.g., 56 millimeters); and in other embodiments, a diameter of bore 66 can be less than 20 millimeters (e.g., 15, 10, 5 millimeters, or less) or more than 80 millimeters (e.g., 85, 90, 95 millimeters, or more). Apparatus 10 is configured to permit fluid to enter apparatus 10 through inlets 26 and to move through channel 70 (e.g., in the embodiment shown, between body 34 and body 58 and also between at least a portion of tip 42 and at least a portion of tip 62) and out of tip 62 of first outer member 54.

In the embodiment shown, combustion apparatus 10 further comprises second outer member 74. Second outer member 74 includes body 78 coupled to base 14 (e.g., upper latitudinal member 22). Body 78 of second outer member 74 can be coupled to base 14 (e.g., upper latitudinal member 22) in any suitable way (e.g., screws, bolts, nails, adhesives, welds, and the like); and in other embodiments, base 14 (e.g., upper latitudinal member 22) and second outer member 74 can be integral (e.g., formed of the same piece of material). In the embodiment shown in FIG. 1, apparatus 10 comprises inlets 80 extending through a portion of second outer member 74. Apparatus 10 can comprise any number of inlets 80, such as, for example, one, two, three, four, five, six, or more inlets 80. Inlets 80 are in fluid communication with apparatus 10 such that fluid can enter apparatus 10 (e.g., into channel 90) through inlets 80. In the embodiment shown, body 78 of second outer member 74 is substantially cylindrical. Second outer member 74 also includes tip 82, which is integral with body 74. In the embodiment shown, tip 82 of second outer member 74 is substantially curved. Tip 62 of first outer member 54 comprises a different curvature than tip 82 of second outer member 74, though in some embodiments, tip 62 and tip 82 can comprise the same or similar curvature. In the embodiment shown, at least a portion of tip 42 of center member 30 is farther from base 14 than tip 82 of second outer member 74. Further, in the embodiment shown, at least a portion of tip 82 of second outer member 74 extends toward tip 42 of center member 30. In some embodiments, second outer member 74 comprises a length of 190 to 260 millimeters (e.g., 228 millimeters); and in other embodiments, a length of second outer member 74 can be less than 190 millimeters (e.g., 185, 180, 175 millimeters, or less) or more than 260 millimeters (e.g., 265, 270, 275 millimeters, or more). In some embodiments, second outer member 74 comprises a diameter of 110 to 160 millimeters (e.g., 131.5 millimeters); and in other embodiments, a diameter of second outer member 74 can be less than 110 millimeters (e.g., 105, 100, 95 millimeters, or less) or more than 160 millimeters (e.g., 165, 170, 175 millimeters, or more). In the embodiment shown, second outer member 74 further comprises bore 86, which is concentric with the longitudinal axis of center member 30. Bore 86 extends through body 78 and tip 82. Furthermore, second outer member 74 is positioned such that channel 90 (a portion of bore 86) is defined between first outer member 54 and second outer member 74. For example, in some embodiments, channel 90 can comprise a width of 2 and 8 millimeters (e.g., 5 millimeters). Such widths of channel 90 can be used, for example, with gaseous fuels and air. As another example, a width of channel 90 near tip 42 of center member 30 and/or tip 62 of first outer member 54 can be equal to or less than a quenching distance. In other embodiments, a width of channel 90 near tip 42 of center member 30 and/or tip 62 of first outer member 54 can be equal to or greater than a quenching distance. In some embodiments, bore 86 of second outer member 74 comprises a diameter of 70 to 140 millimeters (e.g., 106 millimeters); and in other embodiments, a diameter of bore 86 can be less than 70 millimeters (e.g., 65, 60, 55 millimeters, or less) or more than 140 millimeters (e.g., 145, 150, 155 millimeters, or more). Apparatus 10 is configured to permit fluid to enter apparatus 10 through inlets 80 and to move through channel 90 (e.g., in the embodiment shown, between body 58 and body 78 and also between at least a portion of tip 42 and at least a portion of tip 82) and out of tip 82 of second outer member 74.

In the embodiment shown, combustion apparatus 10 further comprises third outer member 94. Third outer member 94 is coupled to second outer member 74. Third outer member 94 can be coupled to second outer member 74 in any suitable way (e.g., screws, bolts, nails, adhesives, welds, and the like); and in other embodiments, second outer member 74 and third outer member 94 can be integral (e.g., formed of the same piece of material). In the embodiment shown in FIG. 1, apparatus 10 comprises inlets 98 extending through a portion of third outer member 94. Apparatus 10 can comprise any number of inlets 98, such as, for example, one, two, three, four, five, six, or more inlets 98. Inlets 98 are in fluid communication with apparatus 10 such that fluid can enter apparatus 10 through inlets 98. In the embodiment shown, third outer member 94 is substantially cylindrical. Third outer member 94 further comprises bore 102, which is concentric with the longitudinal axis of center member 30. Furthermore, third outer member 94 is positioned such that channel 106 (a portion of bore 102) is defined between second outer member 74 and third outer member 94. Apparatus 10 is configured to permit fluid to enter apparatus 10 through inlets 98 and to move through channel 106 and out of third outer member 94, such as, for example, if it is desirable to supply secondary fluid (e.g., air) to apparatus 10.

As explained above, apparatus 10 is configured to permit fluid to move through inlets 26, into channel 70, and out of tip 62 of first outer member 54. Further, apparatus 10 is configured to permit fluid to move through inlets 80, into channel 90, and out of tip 82 of second outer member 74. Apparatus 10 is configured such that fluid moving out of tip 62 of first outer member 54 and fluid moving out of tip 82 of second outer member 74 passes over at least a portion of tip 42 of center member 30 and mixes such that at least some fluid from both tip 62 and tip 82 recirculates (e.g., in a recirculation zone) near tip 42 of center member 30. For example, in some embodiments, a first fluid can move through inlets 26, into channel 70, and out of tip 62 of first outer member 54, and a second fluid can move through inlets 80, into channel 90, and out of tip 82 of second outer member 74 such that the first fluid and the second fluid can mix (e.g., near tip 42 of center member 30) and, if ignited, combust.

Fluid moving through apparatus 10 can be non-premixed fluid, partially premixed fluid, and/or premixed fluid. For example, in a non-premixed fluid embodiment, fuel (e.g., methane, propane, hydrogen, ethylene, and the like) can be introduced through inlets 26, into channel 70, and out of tip 62 of first outer member 54, and oxidizer (e.g., air, oxygen, and the like) can be introduced through inlets 80, into channel 90, and out of tip 82 of second outer member 74. As another example, oxidizer (e.g., air, oxygen, and the like) can be introduced through inlets 26, into channel 70, and out of tip 62 of first outer member 54, and fuel (e.g., methane, propane, hydrogen, ethylene, and the like) can be introduced through inlets 80, into channel 90, and out of tip 82 of second outer member 74. As a further example, in a partially premixed fluid embodiment, a mixture of fuel and oxidizer (e.g., a rich mixture) can be introduced through inlets 26, into channel 70, and out of tip 62 of first outer member 54, and an oxidizer (e.g., air, oxygen, and the like) can be introduced through inlets 80, into channel 90, and out of tip 82 of second outer member 74. As another example, in a premixed fluid embodiment, lean premixtures can be introduced through inlets 26, into channel 70, and out of tip 62 of first outer member 54, and rich premixtures can be introduced through inlets 80, into channel 90, and out of tip 82 of second outer member 74. In other premixed fluid embodiments, rich premixtures can be introduced through inlets 26, into channel 70, and out of tip 62 of first outer member 54, and lean premixtures can be introduced through inlets 80, into channel 90, and out of tip 82 of second outer member 74. The lean and rich premixtures can be inflammable mixtures (e.g., by increasing the strength of the rich premixture and reducing the strength of the lean premixture, for example, depending on a type of gaseous fuel), which can, for example, reduce the likelihood of flame flashback. In some embodiments, diluent fuel can also be used.

Figure 3A:
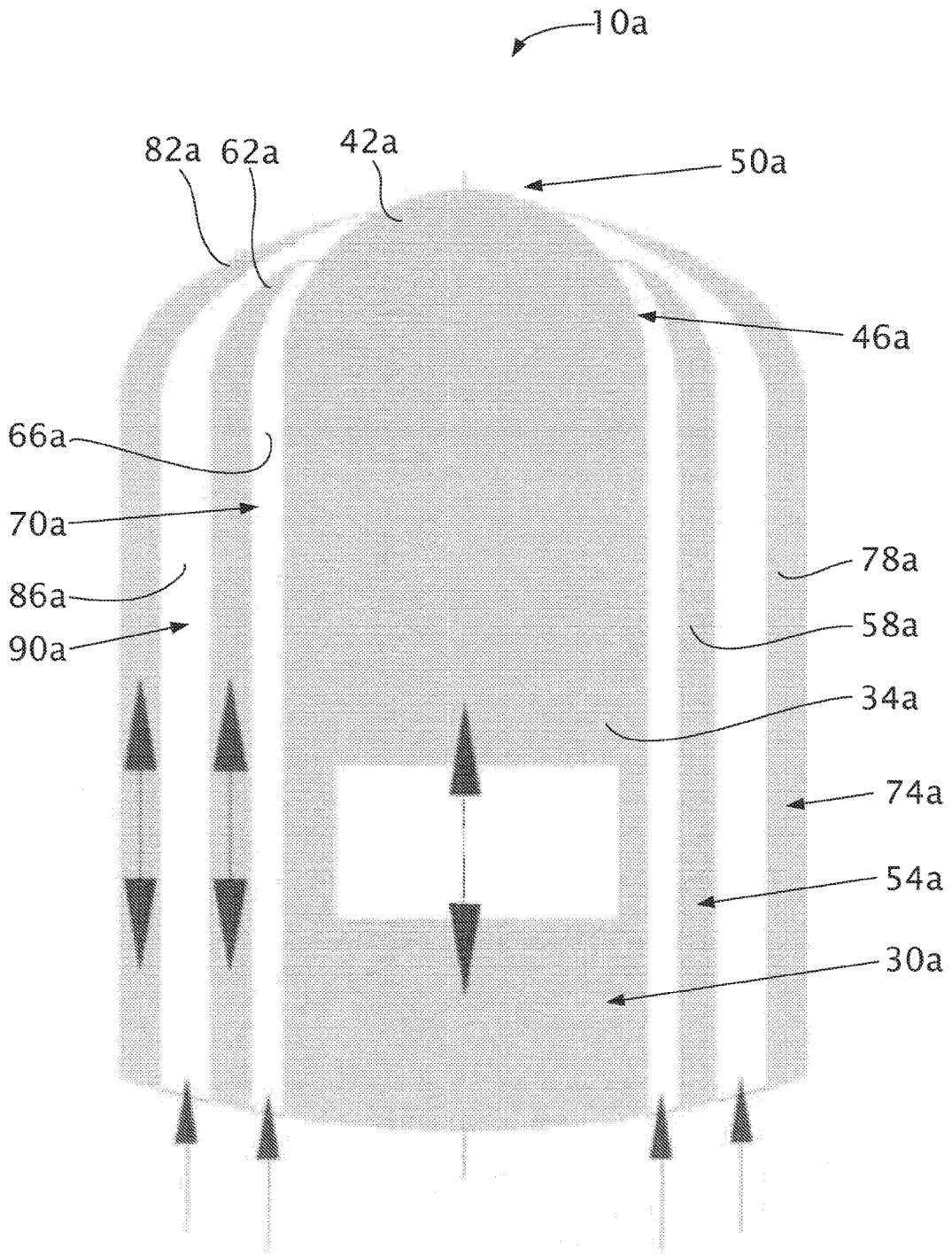
FIG. 3A depicts an embodiment of a portion of a combustion apparatus comprising a center member, a first outer member positioned such that a first channel is defined between the first outer member and the center member, and a second outer member positioned such that a second channel is defined between the second outer member and the first outer member.

FIG. 3A depicts an embodiment of a portion of combustion apparatus 10*a*. Combustion apparatus 10*a* comprises center member 30*a* having a longitudinal axis. Center member 30*a* includes body 34*a* and tip 42*a*, which is integral with body 34*a*. In the embodiment shown, tip 42*a* of center member 30*a* is substantially hemispherical. Tip 42*a* comprises first end 46*a*, which is proximal to body 34*a*, and second end 50*a*, which is distal to body 34*a*. Further, in the embodiment shown, combustion apparatus 10*a* comprises first outer member 54*a*. First outer member 54*a* includes body 58*a*, which is substantially cylindrical, and tip 62*a*, which is integral with body 54*a* and which is substantially curved. In the embodiment shown, at least a portion of tip 62*a* of first outer member 54*a* extends toward tip 42*a* of center member 30*a*. In the embodiment shown, first outer member 54*a* further comprises bore 66*a*, which is concentric with the longitudinal axis of center member 30*a*. Bore 66*a* extends through body 58*a* and tip 62*a*. Furthermore, first outer member 54*a* is positioned such that channel 70*a* (a portion of bore 66*a*) is defined between first outer member 54*a* and center member 30*a*. Apparatus 10*a* is configured to permit fluid to move through channel 70*a* and out of tip 62*a* of first outer member 54*a*. Combustion apparatus 10*a* further comprises second outer member 74*a*. Second outer member 74*a* includes body 78*a*, which is substantially cylindrical, and tip 82*a*, which is integral with body 74*a* and which is substantially curved. In FIG. 3A, tip 62*a* of first outer member 54*a* comprises a different curvature than tip 82*a* of second outer member 74*a*, though in some embodiments, tip 62*a* and tip 82*a* can comprise the same or similar curvature. In the embodiment shown, at least a portion of tip 82*a* of second outer member 74*a* extends toward tip 42*a* of center member 30*a*. Second outer member 74*a* further comprises bore 86*a*, which is concentric with the longitudinal axis of center member 30*a*. Bore 86*a* extends through body 78*a* and tip 82*a*. Second outer member 74*a* is positioned such that channel 90*a* (a portion of bore 86*a*) is defined between first outer member 54*a* and second outer member 74*a*. Apparatus 10*a* is configured to permit fluid to move through channel 90*a* and out of tip 82*a* of second outer member 74*a*.

Figure 3B:
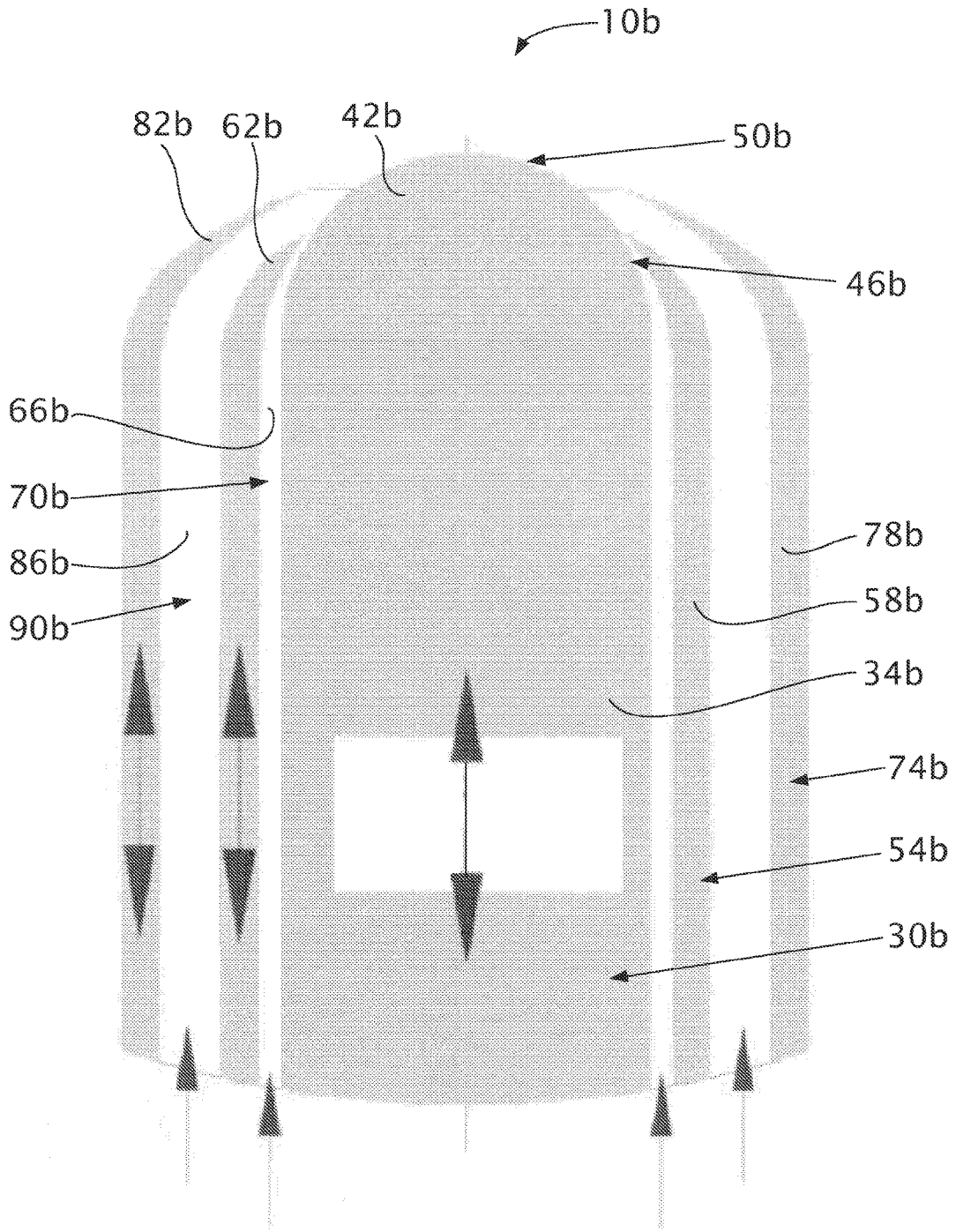
FIG. 3B depicts another embodiment of a portion of a combustion apparatus comprising a center member, a first outer member positioned such that a first channel is defined between the first outer member and the center member, and a second outer member positioned such that a second channel is defined between the second outer member and the first outer member.

FIG. 3B depicts an embodiment of a portion of combustion apparatus 10*b*. Combustion apparatus 10*b* comprises center member 30*b* having a longitudinal axis. Center member 30*b* includes body 34*b* and tip 42*b*, which is integral with body 34*b*. In the embodiment shown, tip 42*b* of center member 30*b* is substantially hemispherical. Tip 42*b* comprises first end 46*b*, which is proximal to body 34*b*, and second end 50*b*, which is distal to body 34*b*. Further, in the embodiment shown, combustion apparatus 10*b* comprises first outer member 54*b*. First outer member 54*b* includes body 58*b*, which is substantially cylindrical, and tip 62*b*, which is integral with body 54*b* and which is substantially curved. In the embodiment shown, at least a portion of tip 62*b* of first outer member 54*b* extends toward tip 42*b* of center member 30*b*. In the embodiment shown, first outer member 54*b* further comprises bore 66*b*, which is concentric with the longitudinal axis of center member 30*b*. Bore 66*b* extends through body 58*b* and tip 62*b*. Furthermore, first outer member 54*b* is positioned such that channel 70*b* (a portion of bore 66*b*) is defined between first outer member 54*b* and center member 30*b*. Apparatus 10*b* is configured to permit fluid to move through channel 70*b* and out of tip 62*b* of first outer member 54*b*. Combustion apparatus 10*b* further comprises second outer member 74*b*. Second outer member 74*b* includes body 78*b*, which is substantially cylindrical, and tip 82*b*, which is integral with body 74*b* and which is substantially curved. In FIG. 3B, tip 62*b* of first outer member 54*b* comprises a different curvature than tip 82*b* of second outer member 74*b*, though in some embodiments, tip 62*b* and tip 82*b* can comprise the same or similar curvature. In the embodiment shown, at least a portion of tip 82*b* of second outer member 74*b* extends toward tip 42*b* of center member 30*b*. Second outer member 74*b* further comprises bore 86*b*, which is concentric with the longitudinal axis of center member 30*b*. Bore 86*b* extends through body 78*b* and tip 82*b*. Second outer member 74*b* is positioned such that channel 90*b* (a portion of bore 86*b*) is defined between first outer member 54*b* and second outer member 74*b*. Apparatus 10*b* is configured to permit fluid to move through channel 90*b* and out of tip 82*b* of second outer member 74*b*.

As depicted by the double-sided arrows in FIGS. 3A-3B, the present combustion apparatuses and components of the such apparatuses can be adjustable. Using FIG. 3A as an example, center member 30*a*, first outer member 54*a*, and/or second outer member 74*a* can be adjustable (e.g., along the longitudinal axis of center member 30*a*) with respect to one or more of the others (or with respect to a base, an example of which is described with respect to FIG. 1) such that at least a portion of channel 70*a* (e.g., the portion of channel 70*a* near tip 42*a* and tip 62*a*) and/or at least a portion of channel 90*a* (e.g., the portion of channel 90*a* near tip 42*a* and tip 82*a*) changes in width. For example, if center member 30*a* is adjustable and first outer member 54*a* and/or second outer member 74*a* is fixed, center member 30*a* can be adjusted (e.g., longitudinally) such that at least a portion of channel 70*a* and/or at least a portion of channel 90*a* increases or decreases in width. As another example, if center member 30*a* is fixed and first outer member 54*a* and/or second outer member 74*a* is adjustable, first outer member 54*a* and/or second outer member 74*a* can be adjusted (e.g., longitudinally) such that at least a portion of channel 70*a* and/or channel 90*a*, respectively, increases or decreases in width. In some embodiments, a center member, a first outer member, and a second outer member can all be adjustable. Such adjustability can, for example, increase control of flame velocity and flame stability. As another example, the width of a channel can be adjusted comparably to the quenching distance (e.g., corresponding to used fuel), which can prevent flashback.

Figure 4A:
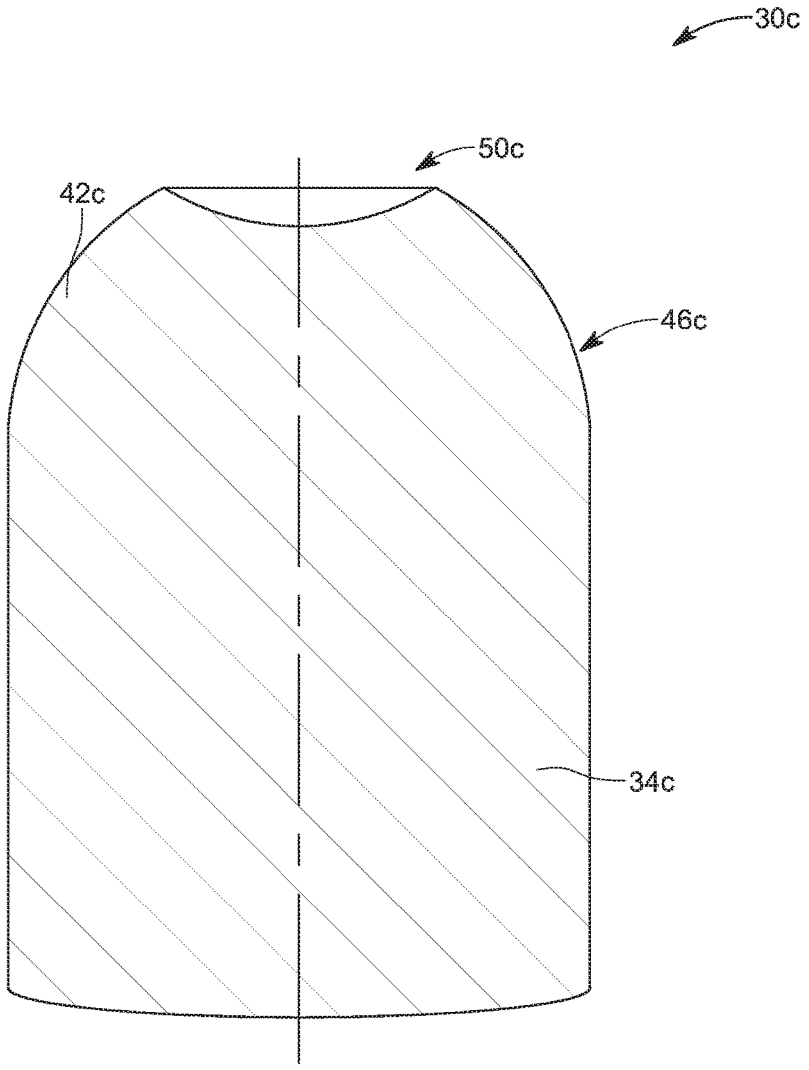
FIG. 4A depicts an embodiment of a portion of a center member of a combustion apparatus, where the tip of the center member has a first end and a second end, and the second end of the tip is substantially concave.

FIGS. 4A-4E depict other embodiments of a portion of combustion apparatuses—and more specifically, other embodiments of a portion of a center member. For example, FIG. 4A depicts center member 30*c* having a longitudinal axis. Center member 30*c* includes body 34*c* and tip 42*c*, which is integral with body 34*c*. In the embodiment shown, tip 42*c* of center member 30*c* is substantially hemispherical. Tip 42*c* comprises first end 46*c*, which is proximal to body 34*c*, and second end 50*c*, which is distal to body 34*c*. In the embodiment shown in FIG. 4A, second end 50*c* of tip 42*c* is substantially concave. Similarly, in the embodiment shown in FIG. 1, second end 50 of tip 42 is substantially concave. The diameter of the concave portion of the second end of a tip can be varied, depending on, for example, a desired size or spatial extent of a recirculation zone, a desired flame appearance, a desired flame height, and/or a desired flame stability. For example, in some embodiments, a diameter of the concave portion of the second end of a tip can be 16 to 32 millimeters (e.g., 24 millimeters). A concave configuration of a second end of a tip of a center member (e.g., such as those depicted in FIGS. 1 and 4A) can, for example, increase flame stability, encourage recirculation of fluid (e.g., due to a greater or lesser amount of space for recirculation near a second end of a tip of a center member), increase the burner load, alter the flame appearance, and alter the flame height.

Figure 4B:
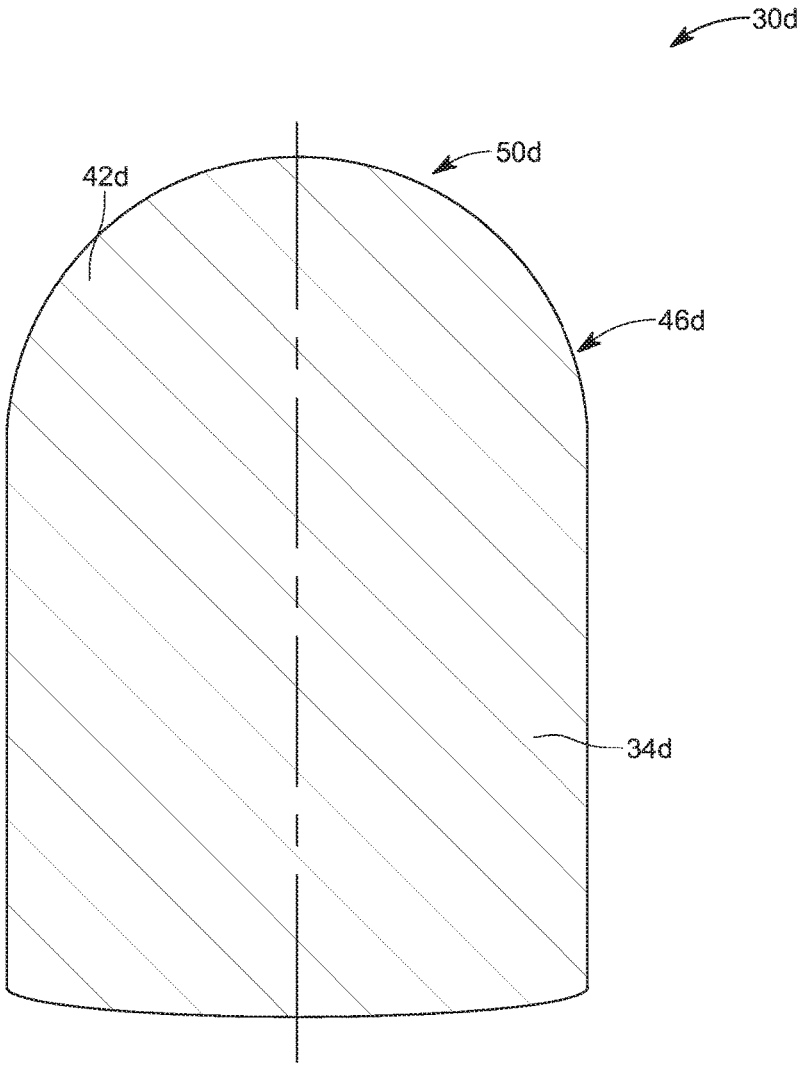
FIG. 4B depicts another embodiment of a portion of a center member of a combustion apparatus.

As depicted in FIG. 4B, a tip of a center member may not comprise a concave portion. For example, center member 30*d* has a longitudinal axis and includes body 34*d* and tip 42*d*, which is integral with body 34*d*. In the embodiment shown, tip 42*d* of center member 30*d* is substantially hemispherical. Tip 42*d* comprises first end 46*d*, which is proximal to body 34*d*, and second end 50*d*, which is distal to body 34*d*.

Figure 4C:
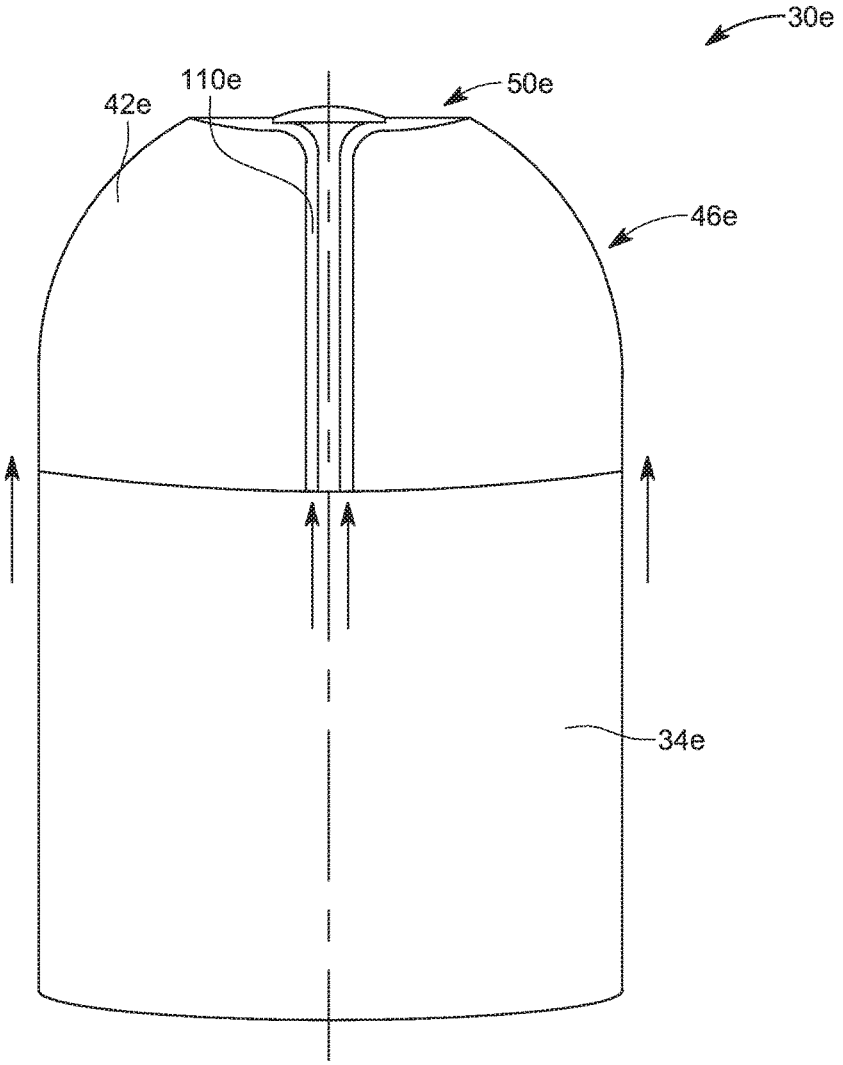
FIG. 4C depicts another embodiment of a portion of a center member of a combustion apparatus, where the center member has a bore.

In some embodiments, as depicted in FIG. 4C, center member 30*e* comprises a longitudinal axis and bore 110*e*, which is concentric with the longitudinal axis of center member 30*e*. Center member 30*e* includes body 34*e* and tip 42*e*, which is integral with body 34*c*. In the embodiment shown, tip 42*e* of center member 30*e* is substantially hemispherical. Tip 42*e* comprises first end 46*e*, which is proximal to body 34*e*, and second end 50*e*, which is distal to body 34*e*. Bore 110*e* extends through body 34*e* and tip 42*e* of center member 30*e*. Center member 30*e* is configured to permit fluid to move through bore 110*e* and out of tip 42*e*, which can, for example, increase flame stability (e.g., by supplying a percentage of fuel to fluid (e.g., recirculating fluid) near tip 42*e* of center member 30*e*, increasing the temperature of such fluid such that flame quenching is reduced at high strain regions) and aerodynamically strengthen a recirculation zone near tip 42*e* of center member 30*e*. For example, fuel can be introduced to bore 110*e* of center member 30*e* such that the fuel can mix with other fluids near second end 50*e* of tip 42*e* of center member 30*e* (e.g., in a recirculation zone).

Figure 4D:
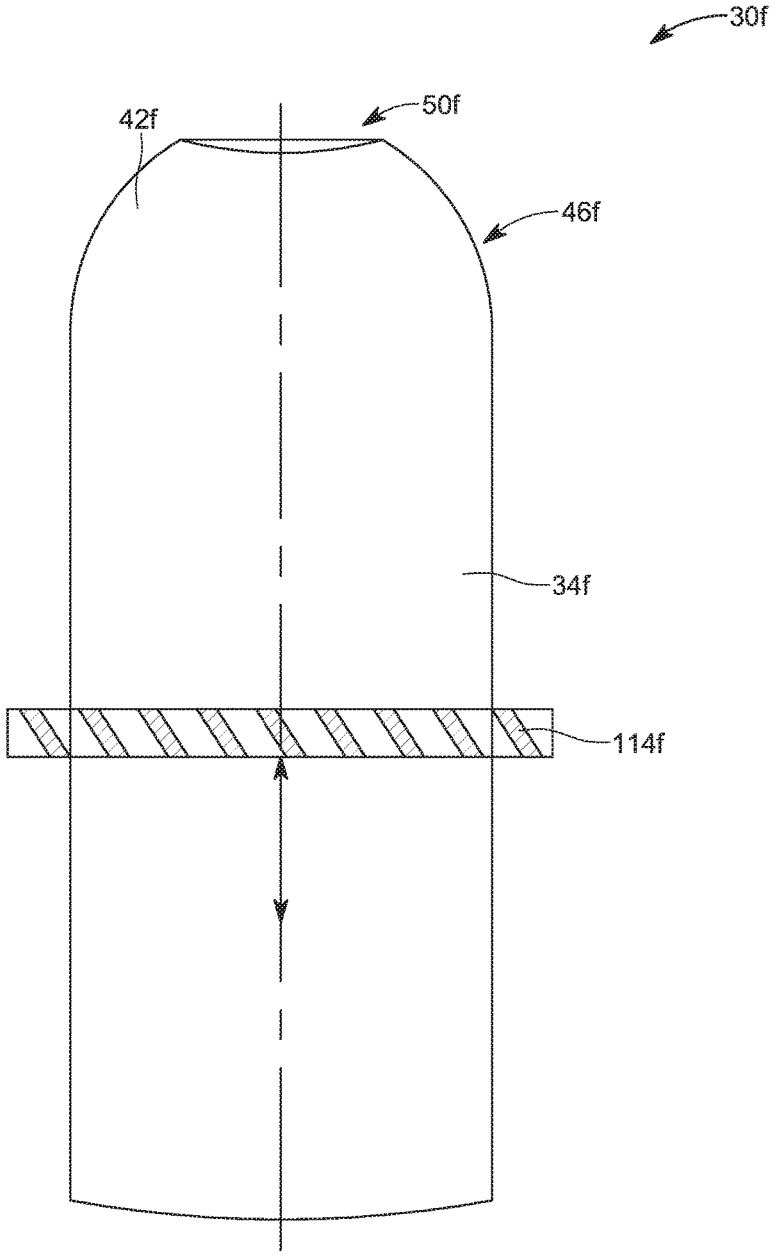
FIG. 4D depicts another embodiment of a portion of a center member of a combustion apparatus, where the combustion apparatus comprises a swirling vane coupled to the center member.

As another example depicted in FIG. 4D, center member 30*f* has a longitudinal axis, body 34*f*, and tip 42*f*, which is integral with body 34*f*. In the embodiment shown, tip 42*f* of center member 30*f* is substantially hemispherical. Tip 42*f* comprises first end 46*f*, which is proximal to body 34*f*, and second end 50*f*, which is distal to body 34*f*. In the embodiment shown, swirling vane 114*f* is coupled to center member 30*f* to, for example, encourage a swirling flow and mixing of fluid. In some embodiments, where center member 30*f* comprises a bore concentric with the longitudinal axis of center member 30*f* and extending through body 34*f* and tip 42*f* of center member 30*f* (e.g., similar to that depicted in FIG. 4C), swirling vane 114*f* is configured to disturb fluid moving through the bore of center member 30*f* In other embodiments, swirling vane 114*f* extends at least partially into a first channel defined by center member 30*f* and a first outer member such that fluid moving through the first channel is disturbed. In still other embodiments, swirling vane 114*f* extends at least partially into a second channel defined by a first outer member and a second outer member such that fluid moving through the second channel and/or the first channel is disturbed.

Some embodiments of the present combustion apparatuses can be configured to increase swirling flow and mixing of fluid by introducing fluid to a combustion apparatus substantially perpendicular to a given flow, a given bore, and/or a given channel (e.g., flow through a bore of a center member, through a first channel defined by a center member and a concentric first outer member, through a second channel defined by the first outer member and a concentric second outer member, etc.). Such introduction of fluid can, for example, give the flow field a tangential velocity component near the tip of the center member, which encourages recirculation of fluid near the tip of the center member.

Figure 4E:
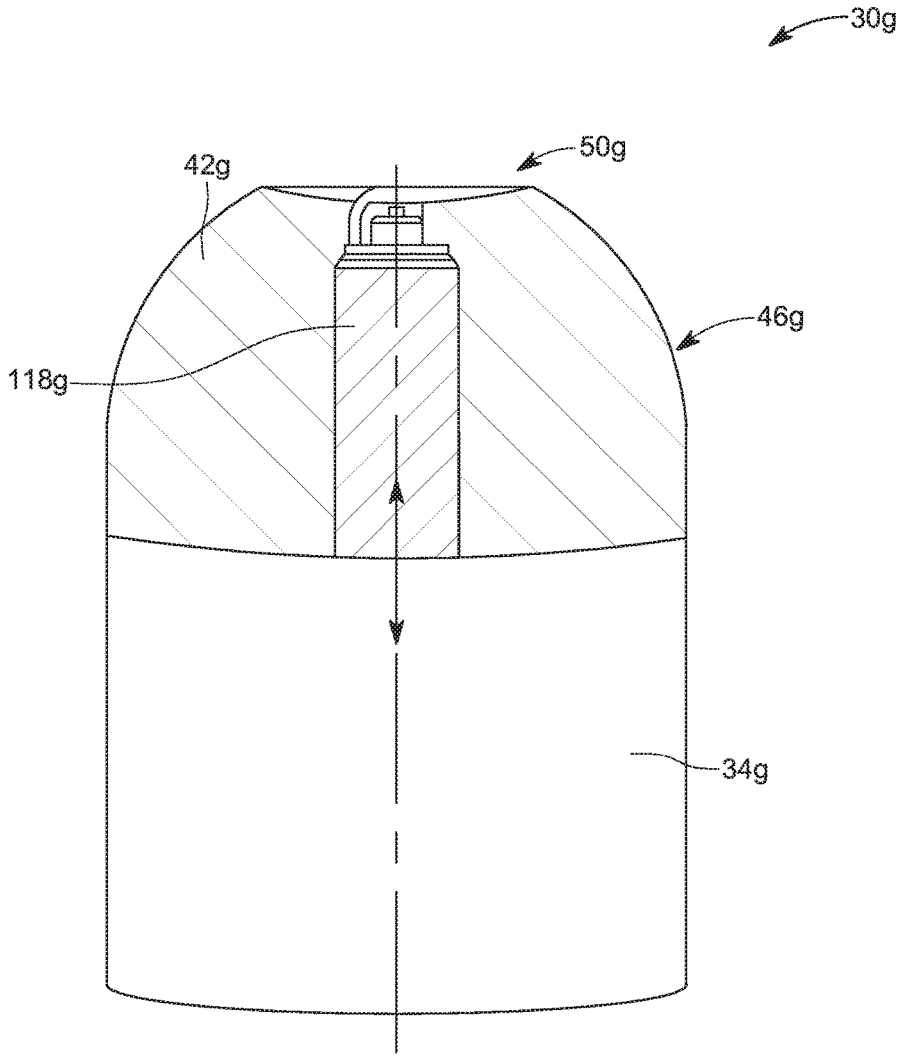
FIG. 4E depicts another embodiment of a portion of a center member of a combustion apparatus, where the combustion apparatus comprises a spark plug coupled to the center member.

As depicted in FIG. 4E, center member 30*g* includes a longitudinal axis, body 34*g*, and tip 42*g*, which is integral with body 34*g*. In the embodiment shown, tip 42*g* of center member 30*g* is substantially hemispherical. Tip 42*g* comprises first end 46*g*, which is proximal to body 34*g*, and second end 50*g*, which is distal to body 34*g*. In the embodiment shown, spark plug 118*g* is coupled to center member 30*g*. If activated, spark plug 118*g* can ignite fluid near tip 42*g* of center member 30*g* (e.g., a mixture of fluid from a bore of center member 30*g*, fluid from a first channel defined by a center member and a concentric first outer member, and/or fluid from a second channel defined by the first outer member and a concentric second outer member).

Figure 5:
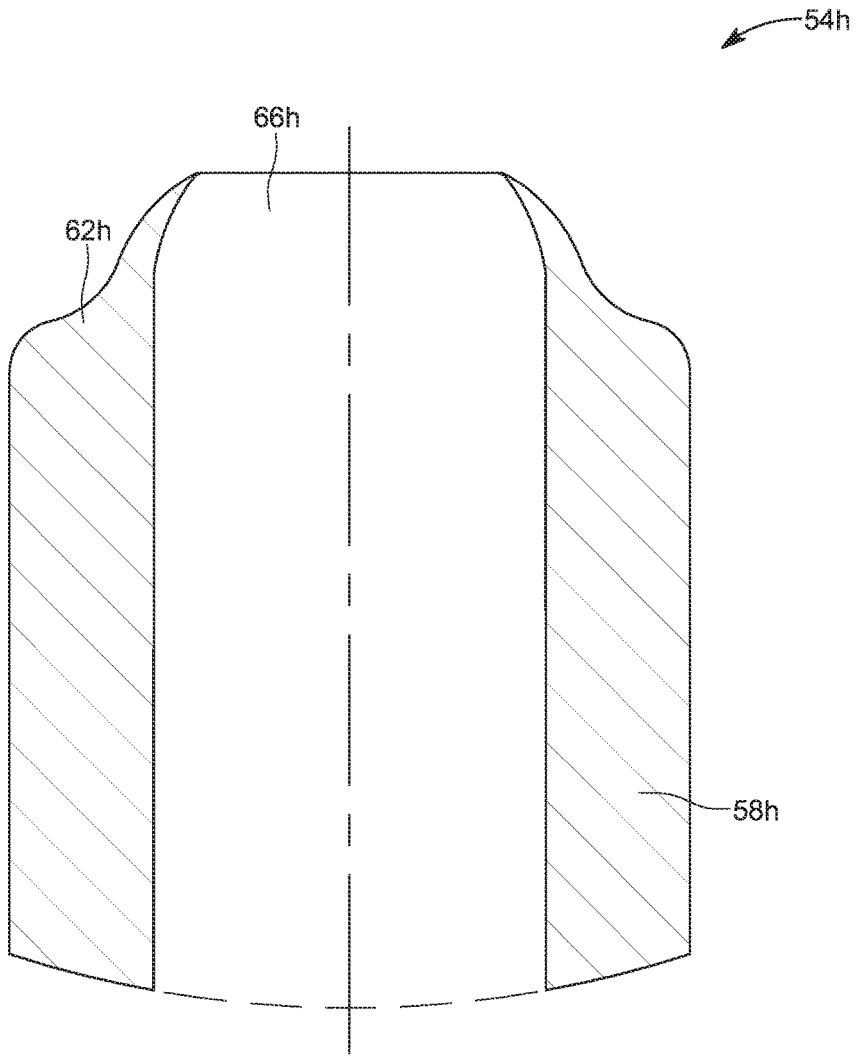
FIG. 5 depicts an embodiment of a portion of a first outer member of a combustion apparatus.

FIG. 5 depicts another embodiment of a portion of combustion apparatuses—and more specifically, another embodiment of a portion of a first outer member. First outer member 54*h* depicted in FIG. 5 comprises body 58*h*, which is substantially cylindrical, and tip 62*h*, which is integral with body 58*h* and which is substantially curved. In the embodiment shown, first outer member 54*h* further comprises bore 66*h* that extends through body 58*h* and tip 62*h*. First outer member 54*h* can be positioned concentric with a longitudinal axis of a center member (e.g., such as any of the center members depicted in FIGS. 1-4E) such that a channel (a portion of bore 66*h*) is defined between first outer member 54*h* and the center member. First outer member 54*h* is configured to permit fluid to move through the channel and out of tip 62*h* of first outer member 54*h*.

Figure 6:
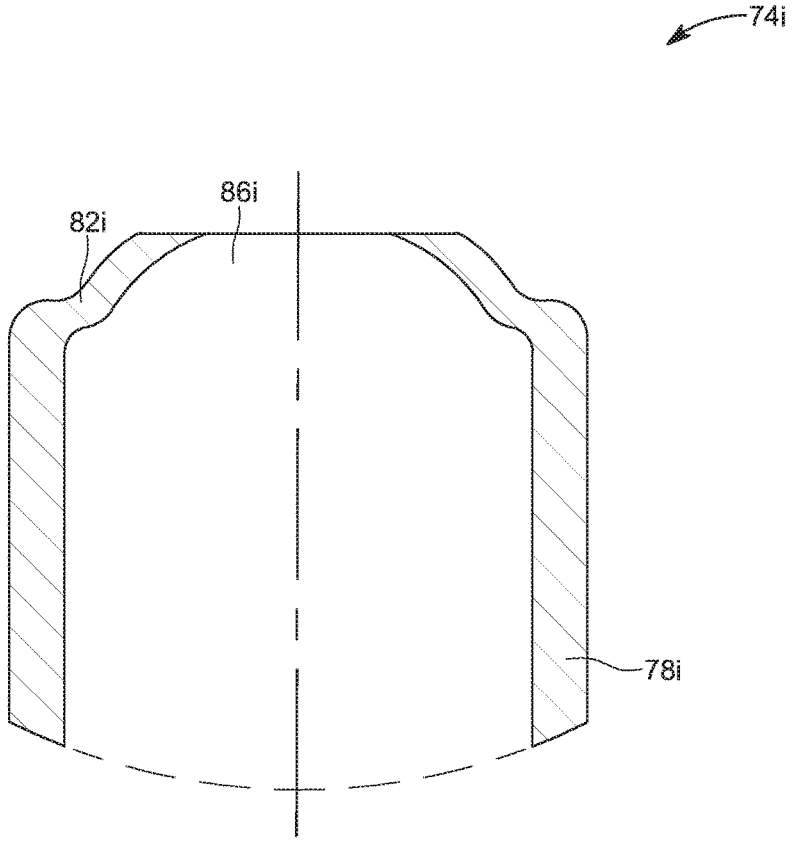
FIG. 6 depicts an embodiment of a portion of a second outer member of a combustion apparatus.

FIG. 6 depicts another embodiment of a portion of combustion apparatuses—and more specifically, another embodiment of a portion of a second outer member. Second outer member 74*i* depicted in FIG. 5 comprises body 78*i*, which is substantially cylindrical, and tip 82*i*, which is integral with body 78*i* and which is substantially curved. In the embodiment shown, second outer member 74*i* further comprises bore 86*i* that extends through body 78*i* and tip 82*i*. Second outer member 74*i* can be positioned concentric with a longitudinal axis of a center member (e.g., such as any of the center members depicted in FIGS. 1-4E and 8) such that, if a first outer member (e.g., such as any of the first outer members depicted in FIGS. 1-3B, 5, and 8) is also positioned concentric with a longitudinal axis of a center member, a channel (a portion of bore 86*i*) is defined between the first outer member and second outer member 74*i*. Second outer member 74*i* is configured to permit fluid to move through the channel and out of tip 82*i* of second outer member 74*i*.

Figure 7:
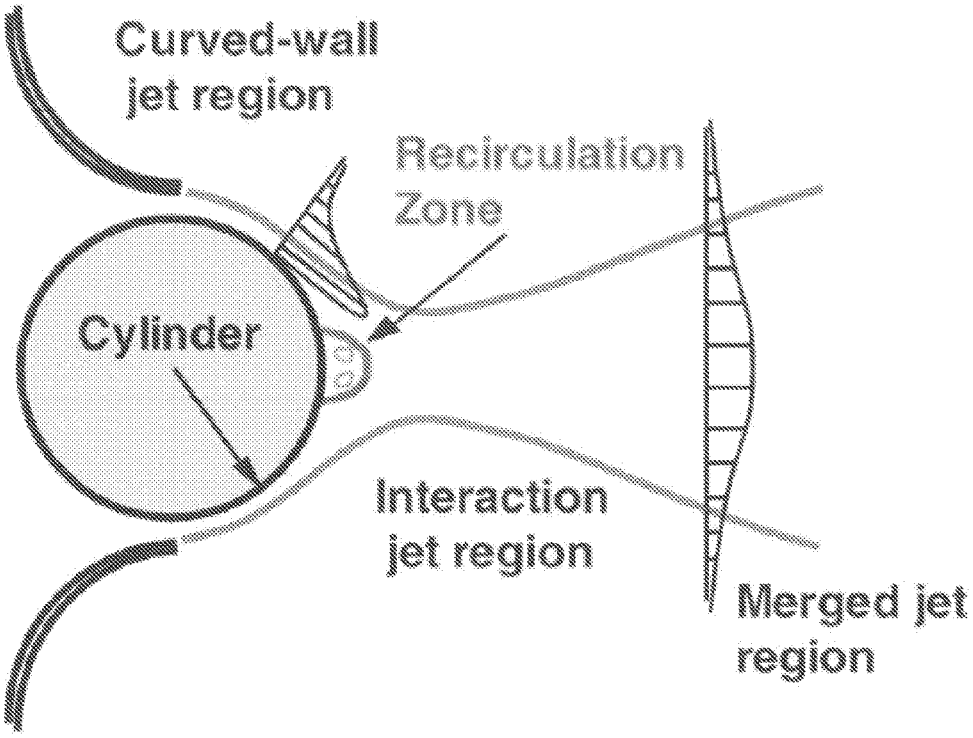
FIG. 7 depicts an example of the Coanda effect.

If fluid flows over a curved surface (e.g., over two sides of a curved surface, such as over a circle, as illustrated in FIG. 7), the Coanda effect can be observed, which is encouraged by the disclosed combustion apparatuses. Fluid flow over curved surfaces generates a region of low pressure, which results in a relative delay in fluid separation. As fluid approaches an end of the curved surface, the fluid begins to recover static pressure and approach ambient pressure. A recirculation zone can form near the end of the curved surface. If fluid flows over two sides of a curved surface, such as a circle, the fluid on either side of the curved surface can mix in the recirculation zone (e.g., inducing entrainment) and continue to mix downstream from the recirculation zone.

Figure 8:
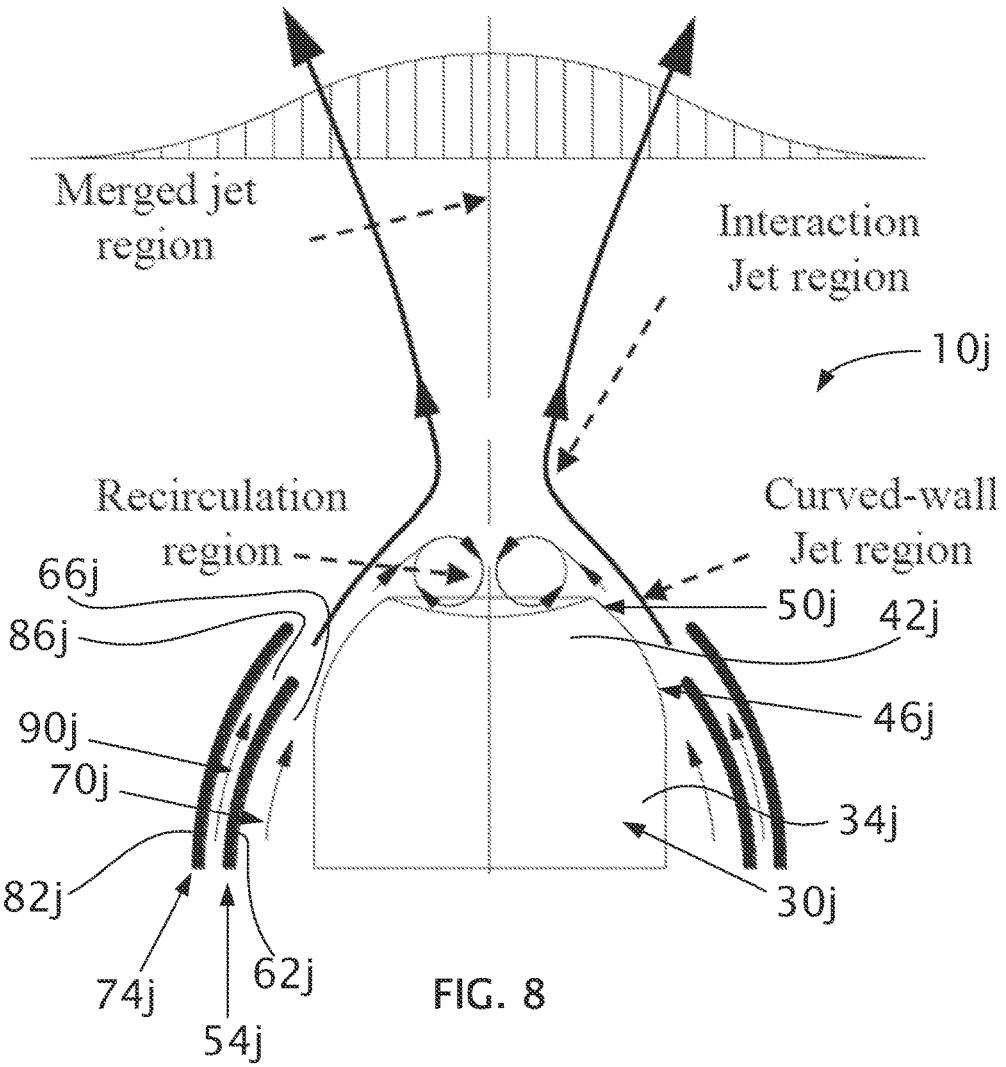
FIG. 8 depicts an example of fluid flow over a portion of one embodiment of the present combustion apparatuses.

FIG. 8 depicts an embodiment of a portion of combustion apparatus 10*j*. Combustion apparatus 10*j* comprises center member 30*j* having a longitudinal axis. Center member 30*j* includes body 34*j* and tip 42*j*, which is integral with body 34*j*. In the embodiment shown, tip 42*j* of center member 30*j* is substantially hemispherical. Tip 42*j* comprises first end 46*j*, which is proximal to body 34*j*, and second end 50*j*, which is distal to body 34*j*. In the embodiment shown in FIG. 8, second end 50*j* of tip 42*j* is substantially concave. Further, in the embodiment shown, combustion apparatus

10*j* comprises first outer member 54*j*. In the embodiment shown, first outer member 54*j* includes tip 62*j*, which is substantially curved. In the embodiment shown, first outer member 54*j* further comprises bore 66*j*, which is concentric with the longitudinal axis of center member 30*j*. Bore 66*j* extends through tip 62*j*. Furthermore, first outer member 54*j* is positioned such that channel 70*j* (a portion of bore 66*j*) is defined between first outer member 54*j* and center member 30*j*. Apparatus 10*j* is configured to permit fluid to move through channel 70*j* and out of tip 62*j* of first outer member 54*j*. Combustion apparatus 10*j* further comprises second outer member 74*j*. Second outer member 74*j* includes tip 82*j*, which is substantially curved. In FIG. 8, tip 62*j* of first outer member 54*j* and tip 82*j* of second outer member 74*j* comprise a similar curvature; though, in other embodiments, tip 62*j* and tip 82*j* can comprise a different curvature. Second outer member 74*j* further comprises bore 86*j*, which is concentric with the longitudinal axis of center member 30*j*. Bore 86*j* extends through tip 82*j*. Second outer member 74*j* is positioned such that channel 90*j* (a portion of bore 86*j*) is defined between first outer member 54*j* and second outer member 74*j*. Apparatus 10*j* is configured to permit fluid to move through channel 90*j* and out of tip 82*j* of second outer member 74*j*. The embodiment shown in FIG. 8 demonstrates an example of the Coanda effect, which is encouraged by the combustion apparatus of FIG. 8, as well as the other combustion apparatuses described and depicted in the present disclosure. Fluid flow over curved surfaces of tip 42*j*, tip 62*j*, and tip 82*j* generates a region of low pressure, which results in a relative delay in fluid separation. As fluid approaches an end of a curved surface, the fluid begins to recover static pressure and approach ambient pressure. As depicted in FIG. 8, a recirculation zone is formed near the substantially concave portion of tip 42*j* of center member 30*j*. Fluid can mix in the recirculation zone (e.g., inducing entrainment) and continue to mix downstream from the recirculation zone.

Figure 9:
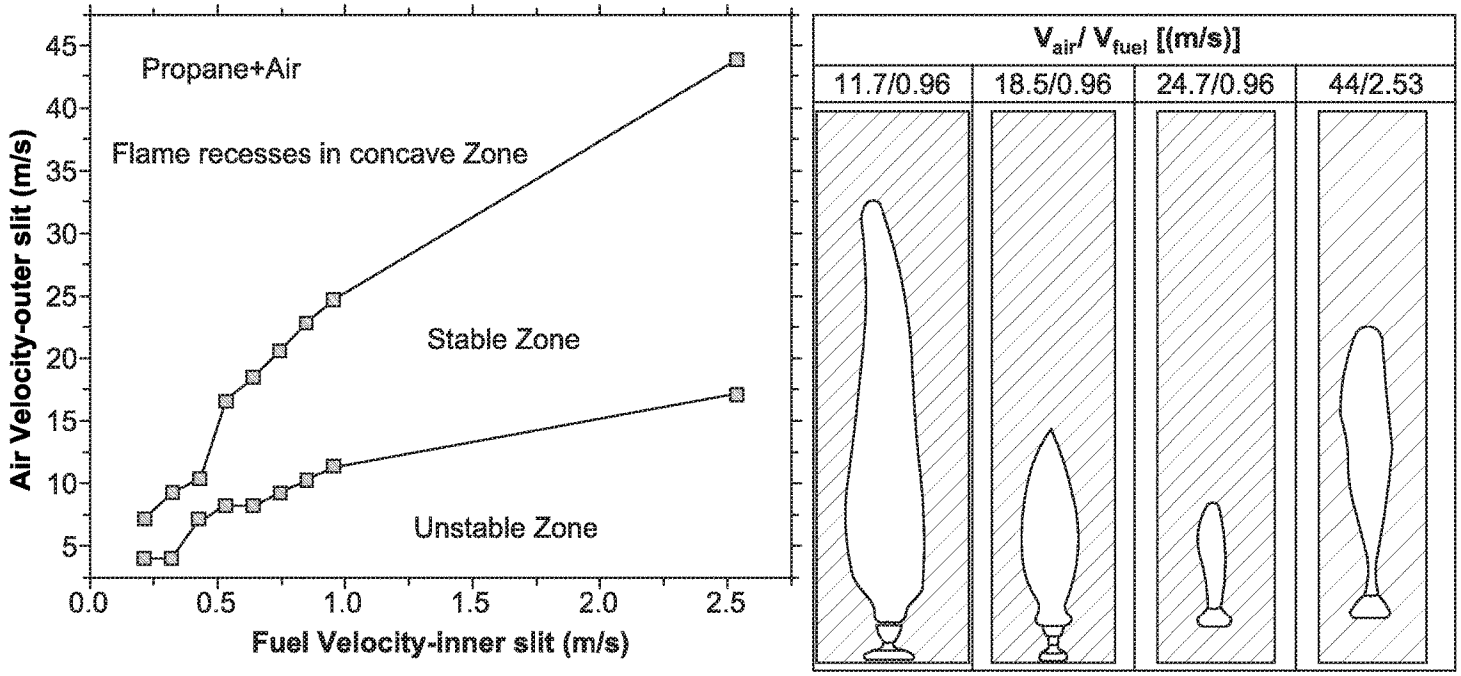
FIG. 9 depicts experimental results from the use of one embodiment of the present combustion apparatuses.

FIG. 9 depicts experimental results from the use of one embodiment of the present combustion apparatuses that comprises a center member having a longitudinal axis and a substantially hemispherical tip, a first outer member having a bore and positioned such that a first channel is defined between the first outer member and the center member, and a second outer member having a bore and positioned such that a second channel is defined between the second outer member and the first outer member.

Some embodiments of the present methods comprise introducing a first fluid into a first channel (e.g., channel 70) defined by a center member (e.g., center member 30) having a tip (e.g., tip 42), where at least a portion of the tip is substantially hemispherical, and a first outer member (e.g., first outer member 54); introducing a second fluid into a second channel (e.g., channel 90) defined by the first outer member and a second outer member (e.g., second outer member 74); permitting the first fluid and the second fluid to flow over the tip of the center member and to mix; and igniting the mixture of the first fluid and the second fluid. In some embodiments, the method comprises introducing the first fluid into the first channel substantially perpendicular to the first channel. In some embodiments, the method comprises introducing the second fluid into the second channel substantially perpendicular to the second channel. In some embodiments, the method comprises adjusting the center member with respect to the first outer member and the second outer member such that at least a portion of the first channel and the second channel changes in width. In some embodiments, the method comprises adjusting the first outer member with respect to the center member such that at least a portion of the first channel changes in width. In some embodiments, a width of the at least a portion of the first channel is similar to (e.g., equal to, greater than, or less than) a quenching distance. In some embodiments, the method comprises adjusting the second outer member with respect to the center member such that at least a portion of the second channel changes in width. In some embodiments, a width of the at least a portion of the second channel is similar to (e.g., equal to, greater than, or less than) a quenching distance. In some embodiments, a spark plug (e.g., spark plug 118*g*) is coupled to the center member, and the method further comprising igniting the mixture of the first fluid and the second fluid with the spark plug. In some embodiments, the first fluid comprises fuel and the second fluid comprises air. In some embodiments, the first fluid comprises air and the second fluid comprises fuel. In some embodiments, the first fluid comprises fuel and the second fluid comprises an oxidizer. In some embodiments, the first fluid comprises an oxidizer and the second fluid comprises fuel. In some embodiments, the first fluid comprises a mixture of air and fuel and the second fluid comprises a mixture of fuel and air. In some embodiments, the first fluid comprises a mixture of oxidizer and fuel and the second fluid comprises a mixture of fuel and oxidizer. In some embodiments, the first fluid comprises a lean pre-mixture and the second fluid comprises a rich pre-mixture. In some embodiments, the first fluid comprises a rich pre-mixture and the second fluid comprises a lean pre-mixture. In some embodiments, the lean pre-mixture and the rich pre-mixture are inflammable.

Some embodiments of the present methods comprise introducing a first fluid into a first channel (e.g., channel 70) defined by a center member (e.g., center member 30*e*) and a first outer member (e.g., first outer member 54); introducing a second fluid into a second channel (e.g., channel 90) defined by the first outer member and a second outer member (e.g., second outer member 74); introducing a third fluid through a bore (e.g., bore 110*e*) of the center member, where the center member has a longitudinal axis and comprises: a body (e.g., body 34*e*), where at least a portion of the body is substantially cylindrical; and a tip (e.g., tip 42*e*) integral with the body, where at least a portion of the tip is substantially hemispherical, where the bore of the center member is concentric with the longitudinal axis of the center member and extends through the body and the tip; permitting the first fluid and the second fluid to flow over the tip of the center member and to mix with the third fluid; and igniting the mixture of the first fluid, the second fluid, and the third fluid. In some embodiments, the method comprises introducing the first fluid into the first channel substantially perpendicular to the first channel. In some embodiments, the method comprises introducing the second fluid into the second channel substantially perpendicular to the second channel. In some embodiments, the method comprises adjusting the center member with respect to the first outer member and the second outer member such that at least a portion of the first channel and the second channel changes in width. In some embodiments, the method comprises adjusting the first outer member with respect to the center member such that at least a portion of the first channel changes in width. In some embodiments, a width of the at least a portion of the second channel is similar to (e.g., equal to, greater than, or less than) a quenching distance. In some embodiments, the method comprises adjusting the second outer member with respect to the center member such that at least a portion of the second channel changes in width. In some embodiments, a width of the at least a portion of the first channel is similar to (e.g., equal to, greater than, or less than) a quenching distance. In some embodiments, a spark plug (e.g., spark plug 118*g*) is coupled to the center member and the method further comprising igniting the mixture of the first fluid, the second fluid, and the third fluid with the spark plug. In some embodiments, the first fluid comprises fuel and the second fluid comprises air. In some embodiments, the first fluid comprises air and the second fluid comprises fuel. In some embodiments, the first fluid comprises fuel and the second fluid comprises an oxidizer. In some embodiments, the first fluid comprises an oxidizer and the second fluid comprises fuel. In some embodiments, the first fluid comprises a mixture of air and fuel and the second fluid comprises a mixture of fuel and air. In some embodiments, the first fluid comprises a mixture of oxidizer and fuel and the second fluid comprises a mixture of fuel and oxidizer. In some embodiments, the first fluid comprises a lean pre-mixture and the second fluid comprises a rich pre-mixture. In some embodiments, the first fluid comprises a rich pre-mixture and the second fluid comprises a lean pre-mixture. In some embodiments, the lean pre-mixture and the rich pre-mixture are inflammable. In some embodiments, the first fluid comprises fuel, the second fluid comprises air, and the third fluid comprises fuel. In some embodiments, the first fluid comprises air, the second fluid comprises fuel, and the third fluid comprises fuel.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present apparatuses and methods are not intended to be limited to the particular forms disclosed. Rather, they include all modifications and alternatives falling within the scope of the claims, and embodiments other than the ones shown may include some or all of the features of the depicted embodiments. For example, components may be combined as a unitary structure and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A combustion apparatus comprising:

a center member having a longitudinal axis and comprising:

a body, where at least a portion of the body is substantially cylindrical; and a tip integral with the body, where at least a portion of the tip is substantially hemispherical;

a first outer member comprising:

a body;

a tip integral with the body; and a bore concentric with the longitudinal axis of the center member;

where the first outer member is positioned such that a first channel is defined between the first outer member and the center member; and a second outer member comprising:

a body;

a tip integral with the body; and a bore concentric with the longitudinal axis of the center member;

where the second outer member is positioned such that a second channel is defined between the second outer member and the first outer member;

where the apparatus is configured to:

permit fluid to move through the first channel and out of the tip of the first outer member; and permit fluid to move through the second channel and out of the tip of the second outer member, and where at least one of the center member, the first outer member and the second outer member is adjustable with respect to others of the center member, the first outer member and the second outer member, such that at least a portion of the first channel or the second channel changes in width.

2. The apparatus of claim 1, where at least a portion of the tip of the first outer member and at least a portion of the tip of the second outer member each extends toward the tip of the center member, where the tip of the center member has a first end and a second end, and the second end of the tip is substantially concave.

3. The apparatus of claim 1, where the center member is 250 to 320 millimeters in length and comprises a diameter of 25 to 75 millimeters.

4. The apparatus of claim 1, where the first outer member is 230 to 300 millimeters in length, where the bore of the first outer member comprises a diameter of 20 to 80 millimeters, and where the first outer member comprises a diameter of 70 to 120 millimeters.

5. The apparatus of claim 1, where the second outer member is 190 to 260 millimeters in length, where the bore of the second outer member comprises a diameter of 70 to 140 millimeters, and where the second outer member comprises a diameter of 110 to 160 millimeters.

6. The apparatus of claim 1, where at least a portion of the first channel comprises a width of 3 millimeters and where at least a portion of the second channel comprises a width of 5 millimeters.

7. The apparatus of claim 1, where the center member is adjustable with respect to the first outer member and the second outer member such that at least a portion of the first channel and the second channel changes in width, or the first outer member is adjustable with respect to the center member such that at least a portion of the first channel changes in width, or the second outer member is adjustable with respect to the center member such that at least a portion of the second channel changes in width.

8. The apparatus of claim 1, further comprising:

four inlets in fluid communication with the first channel through which fluid can enter the first channel; and four inlets in fluid communication with the second channel through which fluid can enter the second channel.

9. The apparatus of claim 1, further comprising:

a swirling vane coupled to the center member and extending at least partially into the first channel such that fluid moving through the first channel is disturbed.

10. The apparatus of claim 9, further comprising:

a swirling vane coupled to the center member and extending at least partially into the second channel such that fluid moving through the first channel and the second channel is disturbed.

11. The apparatus of claim 1, further comprising:

a swirling vane coupled to the center member, where if the center member comprises a bore concentric with the longitudinal axis of the center member and extending through the body and the tip of the center member, fluid moving through the bore of the center member is disturbed.

12. The apparatus of claim 1, where the first outer member is configured such that fluid can be introduced into the first channel substantially perpendicular to the first channel and the second outer member is configured such that fluid can be introduced into the second channel substantially perpendicular to the second channel.

13. The apparatus of claim 1, further comprising:

a spark plug coupled to the center member.

14. The apparatus of claim 1, the center member further comprising a bore concentric with the longitudinal axis of the center member, the bore extending through the body and the tip; and where the apparatus is further configured to permit fluid to move through the bore of the center member and out of the tip of the center member.

15. A combustion apparatus comprising:

a base;

a center member having a longitudinal axis and comprising:

a body, where at least a portion of the body is substantially cylindrical; and a tip integral with the body, where at least a portion of the tip is substantially hemispherical;

a first outer member comprising:

a body;

a tip integral with the body; and a bore concentric with the longitudinal axis of the center member;

where the first outer member is positioned such that a first channel is defined between the first outer member and the center member; and a second outer member comprising:

a body;

a tip integral with the body; and a bore concentric with the longitudinal axis of the center member;

where the second outer member is positioned such that a second channel is defined between the second outer member and the first outer member;

where the apparatus is configured to:

permit fluid to move through the first channel and out of the tip of the first outer member; and permit fluid to move through the second channel and out of the tip of the second outer member, where the body is coupled to the base, where at least a portion of the tip of the center member is farther from the base than the tip of the first outer member, and where at least a portion of the tip of the center member is farther from the base than the tip of the second outer member.

16. A method for combustion comprising:

introducing a first fluid into a first channel defined by:

a center member having a tip, where at least a portion of the tip is substantially hemispherical; and a first outer member;

introducing a second fluid into a second channel defined by the first outer member and a second outer member;

permitting the first fluid and the second fluid to flow over the tip of the center member and to mix;

igniting the mixture of the first fluid and the second fluid; and adjusting at least one of the center member, the first outer member and the second outer member with respect to others of the center member, the first outer member and the second outer member, such that at least a portion of the first channel or the second channel changes in width.

17. The method of claim 16, further comprising:

introducing the first fluid into the first channel substantially perpendicular to the first channel; and introducing the second fluid into the second channel substantially perpendicular to the second channel.

18. The method of claim 16, further comprising:

adjusting the center member with respect to the first outer member and the second outer member such that at least a portion of the first channel and the second channel changes in width, or adjusting the first outer member with respect to the center member such that at least a portion of the first channel changes in width; or adjusting the second outer member with respect to the center member such that at least a portion of the second channel changes in width.

19. The method of claim 18, where a width of the at least a portion of the first channel is similar to a quenching distance, and where a width of the at least a portion of the second channel is similar to a quenching distance.

20. The method of claim 16, where a spark plug is coupled to the center member, the method further comprising:

igniting the mixture of the first fluid and the second fluid with the spark plug.

21. The method of claim 16, where the first fluid comprises one or more of fuel, air, an oxidizer, a mixture of air and fuel, and a mixture of oxidizer and fuel; where the second fluid comprises one or more of fuel, air, an oxidizer, a mixture of air and fuel, and a mixture of oxidizer and fuel; and where the first fluid and the second fluid are not same type of fluid.

22. The method of claim 16, where the first fluid comprises a lean pre-mixture and the second fluid comprises a rich pre-mixture, and where the lean pre-mixture and the rich pre-mixture are inflammable.

23. The method of claim 16, where the first fluid comprises a rich pre-mixture and the second fluid comprises a lean pre-mixture, and where the lean pre-mixture and the rich pre-mixture are inflammable.

24. The method of claim 16, further comprising introducing a third fluid through a bore of the center member, where the center member has a longitudinal axis and comprises:

a body, where at least a portion of the body is substantially cylindrical; and a tip integral with the body, where at least a portion of the tip is substantially hemispherical;

where the bore of the center member is concentric with the longitudinal axis of the center member and extends through the body and the tip.

25. The method of claim 24, where a spark plug is coupled to the center member, the method further comprising:

igniting the mixture of the first fluid, the second fluid, and the third fluid with the spark plug, where the first fluid comprises one or more of air or fuel, the second fluid comprises one or more of air or fuel, and the third fluid comprises fuel; and where the first fluid and the second fluid are not the same type of fluid.

* * * * *